US009816361B2

(12) United States Patent
Yeh et al.

(10) Patent No.: US 9,816,361 B2
(45) Date of Patent: Nov. 14, 2017

(54) DOWNHOLE SAND CONTROL ASSEMBLY WITH FLOW CONTROL, AND METHOD FOR COMPLETING A WELLBORE

(71) Applicants: Charles S. Yeh, Spring, TX (US); Michael T. Hecker, Tomball, TX (US); Michael D. Barry, The Woodlands, TX (US)

(72) Inventors: Charles S. Yeh, Spring, TX (US); Michael T. Hecker, Tomball, TX (US); Michael D. Barry, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 527 days.

(21) Appl. No.: 14/456,565

(22) Filed: Aug. 11, 2014

(65) Prior Publication Data

US 2016/0040515 A1 Feb. 11, 2016

Related U.S. Application Data

(60) Provisional application No. 61/878,461, filed on Sep. 16, 2013.

(51) Int. Cl.
*E21B 43/08* (2006.01)
*E21B 43/14* (2006.01)

(52) U.S. Cl.
CPC ..... *E21B 43/14* (2013.01); *E21B 43/08* (2013.01); *E21B 43/086* (2013.01)

(58) Field of Classification Search
CPC ..... E21B 43/08; E21B 43/086
See application file for complete search history.

(56) References Cited

U.S. PATENT DOCUMENTS 4,945,991 A 8/1990 Jones
5,113,315 A 5/1992 Capp et al.
(Continued)

FOREIGN PATENT DOCUMENTS

EP 1 160 417 A2 12/2001
WO WO 2012/082305 6/2012
WO WO 2013/055451 4/2013

OTHER PUBLICATIONS

Barry, M.D. et al. (2007), "Openhole Gravel Packing with Zonal Isolation," 2007 SPE Annual Technical Conference and Exhibition, SPE 110460, Anaheim, CA, 10 pgs.
(Continued)

*Primary Examiner* — Giovanna C. Wright
(74) *Attorney, Agent, or Firm* — ExxonMobil Upstream Research Company—Law Department

(57) ABSTRACT

A method for completing a wellbore in a subsurface formation includes providing a first base pipe and a second base pipe. Each base pipe comprises a tubular body forming a primary flow path. Each base pipe has transport conduits along an outer diameter for transporting fluids as a secondary flow path. The method also includes connecting the base pipes using a coupling assembly. The coupling assembly has a manifold, and a flow port adjacent the manifold that places the primary flow path in fluid communication with the secondary flow path. The method also includes running the base pipes into the wellbore, and then causing fluid to travel between the primary and secondary flow paths. A sand screen assembly is also provided that allows for control of fluid between primary and secondary flow paths.

41 Claims, 16 Drawing Sheets

(56) References Cited

U.S. PATENT DOCUMENTS

| | | | | |
|---|---|---|---|---|
| 5,396,954 | A | 3/1995 | Brooks | |
| 5,476,143 | A | 12/1995 | Sparlin et al. | |
| 5,479,986 | A | 1/1996 | Gano et al. | |
| 5,588,487 | A | 12/1996 | Bryant | |
| 5,664,628 | A | 9/1997 | Koehler et al. | |
| 5,803,179 | A | 9/1998 | Echols et al. | |
| 5,881,809 | A | 3/1999 | Gillespie et al. | |
| 6,298,916 | B1 | 10/2001 | Tibbles et al. | |
| 6,405,800 | B1 * | 6/2002 | Walker | E21B 43/08 166/235 |
| 6,409,219 | B1 | 6/2002 | Broome et al. | |
| 6,464,261 | B1 | 10/2002 | Dybevik et al. | |
| 6,494,265 | B2 | 12/2002 | Wilson et al. | |
| 6,513,599 | B1 | 2/2003 | Bixenman et al. | |
| 6,516,881 | B2 | 2/2003 | Hailey, Jr. | |
| 6,557,634 | B2 | 5/2003 | Hailey, Jr. et al. | |
| 6,575,251 | B2 | 6/2003 | Watson et al. | |
| 6,581,689 | B2 | 6/2003 | Hailey, Jr. | |
| 6,666,274 | B2 | 12/2003 | Hughes | |
| 6,675,245 | B1 | 1/2004 | Schmidt | |
| 6,695,067 | B2 | 2/2004 | Johnson et al. | |
| 6,749,023 | B2 | 6/2004 | Nguyen et al. | |
| 6,749,024 | B2 | 6/2004 | Bixenman | |
| 6,752,207 | B2 | 6/2004 | Danos et al. | |
| 6,755,245 | B2 | 6/2004 | Nguyen et al. | |
| 6,814,139 | B2 | 11/2004 | Hejl et al. | |
| 6,817,410 | B2 | 11/2004 | Wetzel et al. | |
| 6,848,510 | B2 | 2/2005 | Bixenman et al. | |
| 6,883,608 | B2 | 4/2005 | Parlar et al. | |
| 6,923,262 | B2 | 8/2005 | Broome et al. | |
| 6,983,796 | B2 | 1/2006 | Bayne et al. | |
| 6,986,390 | B2 | 1/2006 | Doane et al. | |
| 7,048,061 | B2 | 5/2006 | Bode et al. | |
| 7,100,691 | B2 | 9/2006 | Nguyen et al. | |
| 7,104,324 | B2 | 9/2006 | Wetzel et al. | |
| 7,147,054 | B2 | 12/2006 | Wang et al. | |
| 7,152,677 | B2 | 12/2006 | Parlar et al. | |
| 7,207,383 | B2 | 4/2007 | Hurst et al. | |
| 7,243,715 | B2 | 7/2007 | Wang et al. | |
| 7,243,723 | B2 | 7/2007 | Surjaatmadja et al. | |
| 7,243,724 | B2 | 7/2007 | McGregor et al. | |
| 7,243,732 | B2 | 7/2007 | Richard | |
| 7,264,061 | B2 | 9/2007 | Dybevik et al. | |
| 7,278,479 | B2 | 10/2007 | Kvernstuen et al. | |
| 7,279,482 | B2 | 10/2007 | Dolezal et al. | |
| 7,343,983 | B2 | 3/2008 | Livingstone | |
| 7,363,974 | B2 | 4/2008 | Wang et al. | |
| 7,370,700 | B2 | 5/2008 | Hurst et al. | |
| 7,407,007 | B2 | 8/2008 | Tibbles | |
| 7,426,962 | B2 | 9/2008 | Moen et al. | |
| 7,431,058 | B2 | 10/2008 | Holting | |
| 7,431,085 | B2 | 10/2008 | Coronado et al. | |
| 7,441,605 | B2 | 10/2008 | Coronado et al. | |
| 7,464,752 | B2 | 12/2008 | Dale et al. | |
| 7,475,725 | B2 | 1/2009 | Yeh et al. | |
| 7,493,959 | B2 | 2/2009 | Johnson et al. | |
| 7,562,709 | B2 | 7/2009 | Saebi et al. | |
| 7,584,799 | B2 | 9/2009 | Coronado et al. | |
| 7,591,321 | B2 | 9/2009 | Whitsitt et al. | |
| 7,597,141 | B2 | 10/2009 | Rouse et al. | |
| 7,661,476 | B2 | 2/2010 | Yeh et al. | |
| 7,735,559 | B2 | 6/2010 | Malone | |
| 7,845,407 | B2 | 12/2010 | Bunnell et al. | |
| 7,870,898 | B2 | 1/2011 | Yeh et al. | |
| 7,891,420 | B2 | 2/2011 | Dale et al. | |
| 7,926,565 | B2 | 4/2011 | Duan et al. | |
| 7,938,184 | B2 | 5/2011 | Yeh et al. | |
| 7,971,642 | B2 | 7/2011 | Yeh et al. | |
| 7,984,760 | B2 | 7/2011 | Haeberle et al. | |
| 8,011,437 | B2 | 9/2011 | Yeh et al. | |
| 8,127,831 | B2 | 3/2012 | Haeberle et al. | |
| 8,186,429 | B2 | 5/2012 | Yeh et al. | |
| 8,215,406 | B2 | 7/2012 | Dale et al. | |
| 8,245,778 | B2 | 8/2012 | Yeh et al. | |
| 8,347,956 | B2 | 1/2013 | Yeh et al. | |
| 8,356,664 | B2 | 1/2013 | Yeh et al. | |
| 8,430,160 | B2 | 4/2013 | Yeh et al. | |
| 8,522,867 | B2 | 9/2013 | Yeh et al. | |
| 2003/0173075 | A1 | 9/2003 | Morvant et al. | |
| 2004/0140089 | A1 | 7/2004 | Gunneroed | |
| 2005/0028977 | A1 | 2/2005 | Ward | |
| 2005/0061501 | A1 | 3/2005 | Ward et al. | |
| 2005/0082060 | A1 | 4/2005 | Ward et al. | |
| 2007/0114020 | A1 | 5/2007 | Brekke | |
| 2008/0314589 | A1 | 12/2008 | Guignard et al. | |
| 2009/0008084 | A1 | 1/2009 | Dybevik et al. | |
| 2009/0159279 | A1 | 6/2009 | Assal | |
| 2009/0159298 | A1 | 6/2009 | Assal | |
| 2009/0283279 | A1 | 11/2009 | Patel et al. | |
| 2010/0065284 | A1 | 3/2010 | Freyer | |
| 2010/0084133 | A1 * | 4/2010 | Weirich | E21B 34/14 166/278 |
| 2010/0096119 | A1 | 4/2010 | Sevre et al. | |
| 2010/0155064 | A1 | 6/2010 | Nutley et al. | |
| 2011/0011577 | A1 | 1/2011 | Dusterhoft et al. | |
| 2011/0024105 | A1 * | 2/2011 | Hammer | E21B 34/14 166/113 |
| 2012/0217010 | A1 | 8/2012 | Haeberle et al. | |
| 2013/0248178 | A1 | 9/2013 | Hecker et al. | |
| 2013/0248179 | A1 | 9/2013 | Yeh et al. | |

OTHER PUBLICATIONS

Hecker, M.T. et al. (2010), "Extending Openhole Gravel Packing Capability: Initial Field Installation of Internal Shunt Alternate Path Technology," SPE Annual Technical Conference and Exhibition, SPE 135102, Florence, Italy, 9 pgs.

Okoroh, K. et al. (2013), "First Commercial Installation of MazeFlo Technology for Remedial Sand Control Application in Ubit Field," Nigeria Annual International Conference and Exhibition, SPE 167532, Lagos, Nigeria, 7 pges.

RU 2 160 360 C2, English translation of Abstract, 1 page.

* cited by examiner

DOWNHOLE SAND CONTROL ASSEMBLY WITH FLOW CONTROL, AND METHOD FOR COMPLETING A WELLBORE

STATEMENT OF RELATED APPLICATIONS

This application claims the benefit of both International Application No. PCT/US2013/064674, filed Oct. 11, 2013, which claims priority to U.S. Ser. No. 61/878,461, filed Sep. 16, 2013, entitled "Downhole Joint Assembly for Flow Control, and Method for Completing a Wellbore," the entirety of both are incorporated herein for all purposes.

This application is also related to U.S. Ser. No. 13/990,803 filed May 31, 2013, entitled "Wellbore Apparatus and Methods For Zonal Isolations and Flow Control," which published as U.S. Patent Publ. No. 2013/0248178, the entirety of which is incorporated herein for all purposes.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of well completions. More specifically, the present invention relates to the isolation of formations in connection with wellbores that have been completed through multiple zones. The application also relates to a wellbore completion apparatus which incorporates bypass technology that allows for in-flow control of production fluids through primary and secondary flow paths along the wellbore.

Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of formations behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

It is sometimes desirable to leave the bottom portion of a wellbore open. In open-hole completions, a production casing is not extended through the producing zones and perforated; rather, the producing zones are left uncased, or "open." A production string or "tubing" is then positioned inside the open wellbore extending down below the last string of casing.

There are certain advantages to open-hole completions versus cased-hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation.

Second, open-hole techniques are oftentimes less expensive than cased hole completions. For example, the use of slotted base pipes eliminates the need for cementing, perforating, and post-perforation clean-up operations. Alternatively, the use of a sand screen, with or without a gravel packs along the open hole wellbore, helps maintain the integrity of the wellbore while allowing substantially 360 degree radial formation exposure.

It is desirable in some open-hole completions to isolate selected zones along the wellbore. For example, it is sometimes desirable to isolate an interval from the production of formation fluids into the wellbore. Annular zonal isolation may also be desired for production allocation, production/injection fluid profile control, selective stimulation, or gas control. This may be done through the use of packers (or a zonal isolation apparatus) that has bypass technology. The bypass technology may employ packing conduits that permit fluids to flow through a sealing element of the packer and across an isolated zone.

The use of bypass technology with a zonal isolation apparatus has been developed in the context of gravel packing. This technology is practiced under the name Alternate Path®, owned by ExxonMobil Corporation of Irving, Tex. Alternate Path® technology employs shunt tubes, or alternate flow channels, that allow a gravel slurry to bypass selected areas, e.g., premature sand bridges or packers, along a wellbore. Such fluid bypass technology is described, for example, in U.S. Pat. No. 5,588,487 entitled "Tool for Blocking Axial Flow in Gravel-Packed Well Annulus," and PCT Publication No. WO2008/060479 entitled "Wellbore Method and Apparatus for Completion, Production, and Injection," each of which is incorporated herein by reference in its entirety. Additional references which discuss alternate flow channel technology include U.S. Pat. No. 8,215,406; U.S. Pat. No. 8,186,429; U.S. Pat. No. 8,127,831; U.S. Pat. No. 8,011,437; U.S. Pat. No. 7,971,642; U.S. Pat. No. 7,938,184; U.S. Pat. No. 7,661,476; U.S. Pat. No. 5,113,315; U.S. Pat. No. 4,945,991; U.S. Pat. Publ. No. 2012/0217010; U.S. Pat. Publ. No. 2009/0294128; M. T. Hecker, et al., "*Extending Openhole Gravel-Packing Capability: Initial Field Installation of Internal Shunt Alternate Path Technology*," SPE Annual Technical Conference and Exhibition, SPE Paper No. 135,102 (September 2010); and M. D. Barry, et al., "*Open-hole Gravel Packing with Zonal Isolation*," SPE Paper No. 110,460 (November 2007). The Alternate Path® technology enables a true zonal isolation in multi-zone, openhole gravel pack completions.

In some open-hole completions, a gravel pack is not employed. This may be due to the formation being sufficiently consolidated that a sand screen and pack are not required. Alternatively, this may be due to economic limitations. In either instance, it is still desirable to run tubular bodies down the wellbore to support packers or other tools, and to provide flow control between a main base pipe and the annulus formed between the base pipe and the surrounding wellbore.

In this instance, a need remains for an improved sand control assembly that provides flow control between a base pipe and a surrounding annular region using fluid bypass technology while filtering production fluids. A need further exists for a sand screen assembly that provides multi-tier subsurface flow control, enabling fluid communication between a primary flow path within the base pipes and alternate flow paths of fluid transport conduits. Additionally, a need exists for a method of completing a wellbore wherein a sand screen assembly is placed along a formation that uses selected fluid communication between the base pipe and bypass channels.

SUMMARY OF THE INVENTION

A sand screen assembly is first provided herein. The sand screen assembly resides within a wellbore. The assembly has particular utility in connection with the control of fluid flow between an internal bore of a base pipe and an annular region outside of the base pipe, all residing within a surrounding open-hole portion of the wellbore. The open-hole portion extends through one, two, or more subsurface intervals.

The sand screen assembly includes a first base pipe and a second base pipe. The two base pipes are connected in series using a coupling assembly. Each base pipe comprises a tubular body. The tubular bodies each have a first end, a second end and a bore defined there between. The bores form a primary flow path for fluids.

Each tubular body also includes filtering media. The filtering media are disposed circumferentially around the tubular body, and reside substantially along the tubular body. The filtering media are configured to create an indirect flow path to the base pipe. In one aspect, this is done by providing at least one primary filtering conduit and at least one secondary filtering conduit along each of the base pipes. The primary filtering conduit forms a first annular region between the tubular body and the surrounding primary filtering conduit. Similarly, the secondary filtering conduit forms a second annular region between the tubular body and the surrounding secondary filtering conduit. A blank tubular housing circumscribes the second filtering conduit and forms a third annular region between the second filtering conduit and the surrounding housing.

The sand screen assembly also includes one or more transport conduits. The transport conduits reside along selected portions of the outer diameter of the base pipes. More specifically, the transport conduits reside within each first annular region, but may or may not reside within the second annular regions. Each of the transport conduits has a bore for providing a secondary flow path for production fluids.

The first and second filtering conduits are laterally adjacent to one another. A cylindrical in-flow ring is disposed along the base pipes intermediate the primary and secondary filtering sections. Each in-flow ring has (i) an inner diameter for sealingly receiving a base pipe, and (ii) flow conduits placing the bore of each transport conduit in fluid communication with the filter media as part of the secondary flow path. Preferably, the flow conduits comprise (i) one or more primary in-flow channels providing fluid communication between the first annular region and the third annular region, and (ii) one or more secondary in-flow channels providing fluid communication between the second annular region and the bore of the transport conduits.

The sand screen assembly also includes the coupling assembly. The coupling assembly is operatively connected to the second end of the first base pipe and to the first end of the second base pipe. The coupling assembly comprises a manifold that places respective transport conduits residing along base pipes in fluid communication.

In one aspect, the coupling assembly comprises a load sleeve and a torque sleeve. The load sleeve is mechanically connected proximate the first end of the second base pipe, while the torque sleeve is mechanically connected proximate the second end of the first base pipe. The load sleeve and the torque sleeve, in turn, are connected by means of an intermediate coupling joint. Preferably, the load sleeve and the torque sleeve are bolted into the respective base pipes to prevent relative rotational movement.

Each of the load sleeve and the torque sleeve comprises a cylindrical body. The sleeves each have an outer diameter, a first and second end, and a bore extending from the first end to the second end. The bore forms an inner diameter in each of the cylindrical bodies. Each of the load sleeve and the torque sleeve also includes at least one transport channel, with each of the transport channels extending along the respective sleeve from the first end to the second end.

The intermediate coupling joint also comprises a cylindrical body that defines a bore therein. The bore is in fluid communication with the primary flow path. A co-axial sleeve is concentrically positioned around a wall of the tubular body, forming an annual region between the tubular body and the sleeve. The annular region defines a manifold region, with the manifold region placing the transport conduits of the load sleeve and the torque sleeve in fluid communication. Preferably, the co-axial sleeve is bolted into the tubular body, preserving spacing of the manifold region.

The load sleeve, the torque sleeve and the intermediate coupling joint form a coupling assembly that operatively connects the first and second base pipes along an open-hole portion of the wellbore. In one aspect, each of the load sleeve and the torque sleeve presents shoulders that receive the opposing ends of the coupling joint. O-rings may be used along the shoulders to preserve a fluid seal. At the same time, the coupling joint has opposing female threads for connecting the first and second base pipes.

In the present invention, the sand screen assembly further includes a flow port. The flow port resides adjacent the manifold and places the primary flow path in fluid communication with the secondary flow path. The manifold region also places respective transport conduits of the base pipes in fluid communication with one another. Preferably, the flow port is in the tubular body of the coupling joint, although it may reside proximate an end of one or both of the threadedly connected base pipes adjacent a second filtering conduit.

The joint assembly further comprises an in-flow control device. The inflow control device resides adjacent an opening in the flow port, or may even define the flow port. The inflow control device is configured to increase or decrease fluid flow through the flow port.

The sand screen assembly preferably also includes a packer assembly. The packer assembly comprises at least one sealing element disposed at an end of either the first base pipe or the second base pipe opposite the coupling assembly. The sealing elements are configured to be actuated to engage a surrounding wellbore wall. The packer assembly also has an inner mandrel which forms a part of the primary flow path.

The sealing element for the packer assembly may include a mechanically-set packer. More preferably, the packer assembly has two mechanically-set packers or annular seals. These represent an upper packer and a lower packer. Each mechanically-set packer has a sealing element that may be, for example, from about 6 inches (15.2 cm) to 24 inches (61.0 cm) in length. Each mechanically-set packer also has an inner mandrel in fluid communication with the base pipe of the sand screens and the base pipe of the joint assembly.

Intermediate the at least two mechanically-set packers may optionally be at least one swellable packer element. The swellable packer element is preferably about 3 feet (0.91 meters) to 40 feet (12.2 meters) in length. In one aspect, the swellable packer element is fabricated from an elastomeric material. The swellable packer element is actuated over time in the presence of a fluid such as water, gas, oil, or a chemical. Swelling may take place, for example, should one of the mechanically-set packer elements fails. Alternatively, swelling may take place over time as fluids in the formation surrounding the swellable packer element contact the swellable packer element.

A method for completing a wellbore in a subsurface formation is also provided herein. The wellbore preferably includes a lower portion completed as an open-hole without gravel packing.

In one aspect, the method includes providing a first base pipe and a second base pipe. The two base pipes are connected in series using a coupling assembly. Each base pipe comprises a tubular body. The tubular bodies each have a first end, a second end and a bore defined there between. The bores form a primary flow path for fluids.

Additionally, each of the tubular bodies preferably includes a filter medium radially around the base pipes. The result is that the tubular bodies form first and second sand screens. Preferably, the filter media are staggered, creating an indirect flow path for fluids into the primary flow path.

Each of the base pipes also has at least one transport conduit. The transport conduit resides along an outer diameter of the base pipe along the first filtering section for transporting fluids as a secondary flow path. Various arrangements for the transport conduits may be used.

Each of the base pipes also includes a cylindrical in-flow ring. The in-flow rings define short tubular bodies that reside between primary and secondary filtering sections along the base pipes. Each in-flow ring has (i) an inner diameter for sealingly receiving a base pipe, and (ii) flow conduits placing the bore of each transport conduit in fluid communication with the filter media as part of secondary flow path. Preferably, the flow conduits of each in-flow ring comprise (i) one or more primary in-flow channels providing fluid communication between the first annular region and the third annular region, and (ii) one or more secondary in-flow channels providing fluid communication between the second annular region and the bore of the transport conduits.

The method also includes operatively connecting the second end of the first base pipe to the first end of the second base pipe. This is done by means of the coupling assembly. In one embodiment, the coupling assembly includes a load sleeve, a torque sleeve, and an intermediate coupling joint. The load sleeve, the torque sleeve, and the coupling joint form a coupling assembly as described above. Of note, the coupling joint includes a flow port residing adjacent the manifold region. The flow port places the primary flow path in fluid communication with the secondary flow path. The manifold region also places respective transport conduits of the base pipes in fluid communication.

The method further includes running the base pipes into the wellbore. The method then includes causing fluid to travel between the primary and secondary flow paths. In one aspect, the method further comprises producing hydrocarbon fluids through the base pipes of the first and second base pipes from at least one interval along the wellbore. Producing hydrocarbon fluids causes hydrocarbon fluids to travel from the secondary flow path to the primary flow path.

In one embodiment, the joint assembly further comprises an in-flow control device adjacent an opening in the flow port. The in-flow control device is configured to increase or decrease fluid flow through the flow port. The in-flow control device may be, for example, a sliding sleeve or a valve. The method may then further comprise adjusting the in-flow control device to increase or decrease fluid flow through the flow port. This may be done through a radio frequency signal, a mechanical shifting tool, or hydraulic pressure.

In another embodiment, the joint assembly further comprises an in-flow control device along the in-flow ring. This controls the flow of production fluids through the primary in-flow channels, through the secondary in-flow channels, or both. The method may then further comprise adjusting the in-flow control device to increase or decrease fluid flow through the in-flow rings.

Optionally, the method further includes providing a packer assembly. The packer assembly is also in accordance with the packer assembly described above in its various embodiments. The packer assembly includes at least one, and preferably two, mechanically-set packers. Alternatively or in addition, the packer assembly also includes at least one swellable sealing element.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 9A provides a perspective view of a primary filtering section. In this view, a split-ring, a welding ring, a primary filtering conduit, and an in-flow ring are shown exploded apart. A portion of the primary filtering section is cut-away, exposing a non-perforated (or blank) base pipe there along.

FIG. 9B provides a perspective view of a secondary filtering section. In this view, an in-flow ring, a baffle ring, a welding ring, and a secondary filtering conduit are shown exploded apart. A portion of the secondary filtering section is cut-away, exposing the blank base pipe there along.

FIG. 12A shows a portion of a sand screen assembly using a single primary filtering conduit and a single secondary filtering conduit, with an in-flow ring disposed there between.

FIG. 12B shows a portion of a sand screen assembly in an alternate embodiment. Here, an arrangement of an indirect-flow path sand screen uses a single primary filtering conduit and a pair of opposing secondary filtering conduits. Two in-flow rings are shown.

FIG. 12C shows a portion of a sand screen assembly in another alternate embodiment. Here, the location of components along the assembly relative to FIG. 12A has been flipped.

FIG. 12D shows a portion of a sand screen assembly that serves as an end joint.

DETAILED DESCRIPTION OF CERTAIN EMBODIMENTS

Definitions

Figure 1:
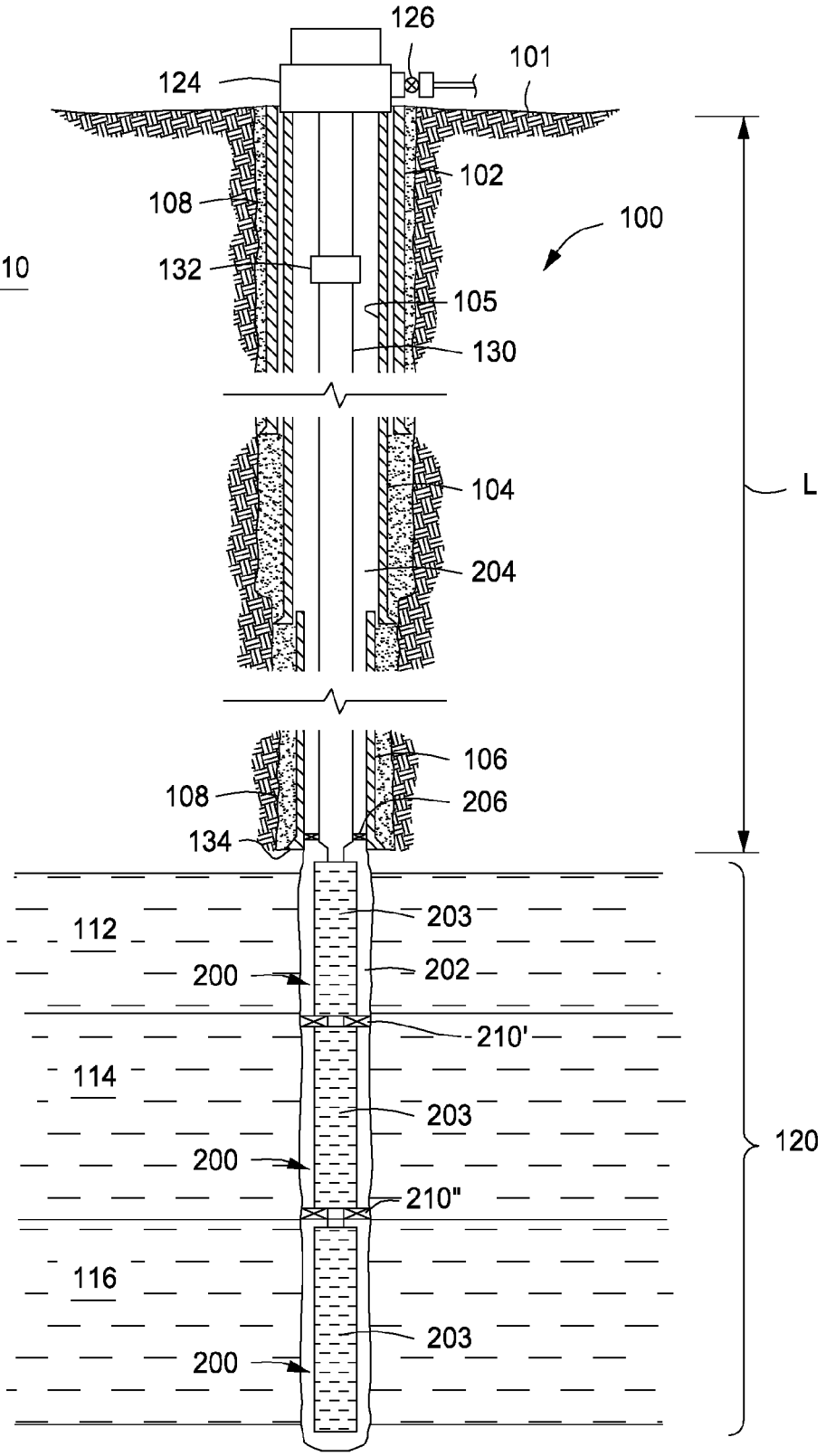
FIG. 1 is a cross-sectional view of an illustrative wellbore. The wellbore has been drilled through three different subsurface intervals, each interval being under formation pressure and containing fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. to 20° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "production fluids" refers to those fluids, including hydrocarbon fluids, that may be received from a subsurface formation into a wellbore.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

Description of Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed for the purpose of producing hydrocarbons for processing or commercial sale. A string of production tubing 130 is provided in the bore 105 to transport production fluids from the open-hole portion 120 up to the surface 101.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or liner hanger. It is understood that a pipe string that does not extend back to the surface (such as casing string 106) is normally referred to as a "liner."

In the illustrative wellbore arrangement of FIG. 1, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through a cement column 108. The cement column 108 isolates the various formations of the subsurface 110 from the wellbore 100 and each other. The column of cement 108 extends from the surface 101 to a depth "L" at a lower end of the casing string 106. It is understood that some intermediate casing strings may not be fully cemented.

An annular region 204 (seen in FIG. 2) is formed between the production tubing 130 and the casing string 106. A production packer 206 seals the annular region 204 near the lower end "L" of the casing string 106.

In many wellbores, a final casing string known as production casing is cemented into place at a depth where subsurface production intervals reside. However, the illustrative wellbore 100 is completed as an open-hole wellbore. Accordingly, the wellbore 100 does not include a final casing string along the open-hole portion 120.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks or natural fractures in the aquifer, or fingering from injection wells. In this instance, there is a probability that water will invade the wellbore 100.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

In any of these events, it is desirable for the operator to isolate selected intervals. In the first instance, the operator will want to isolate the intermediate interval 114 from the production string 130 and from the upper 112 and lower 116 intervals (by use of packer assemblies 210' and 210") so that primarily hydrocarbon fluids may be produced through the wellbore 100 and to the surface 101. In the second instance, the operator will eventually want to isolate the lower interval 116 from the production string 130 and the upper 112 and intermediate 114 intervals so that primarily hydrocarbon fluids may be produced through the wellbore 100 and to the surface 101. In the third instance, the operator will want to isolate the upper interval 112 from the lower interval 116, but need not isolate the intermediate interval 114.

In the illustrative wellbore 100 of FIG. 1, a series of base pipes 200 extends through the intervals 112, 114, 116. The base pipes 200 and connected packer assemblies 210', 210" are shown more fully in FIG. 2.

Figure 2:
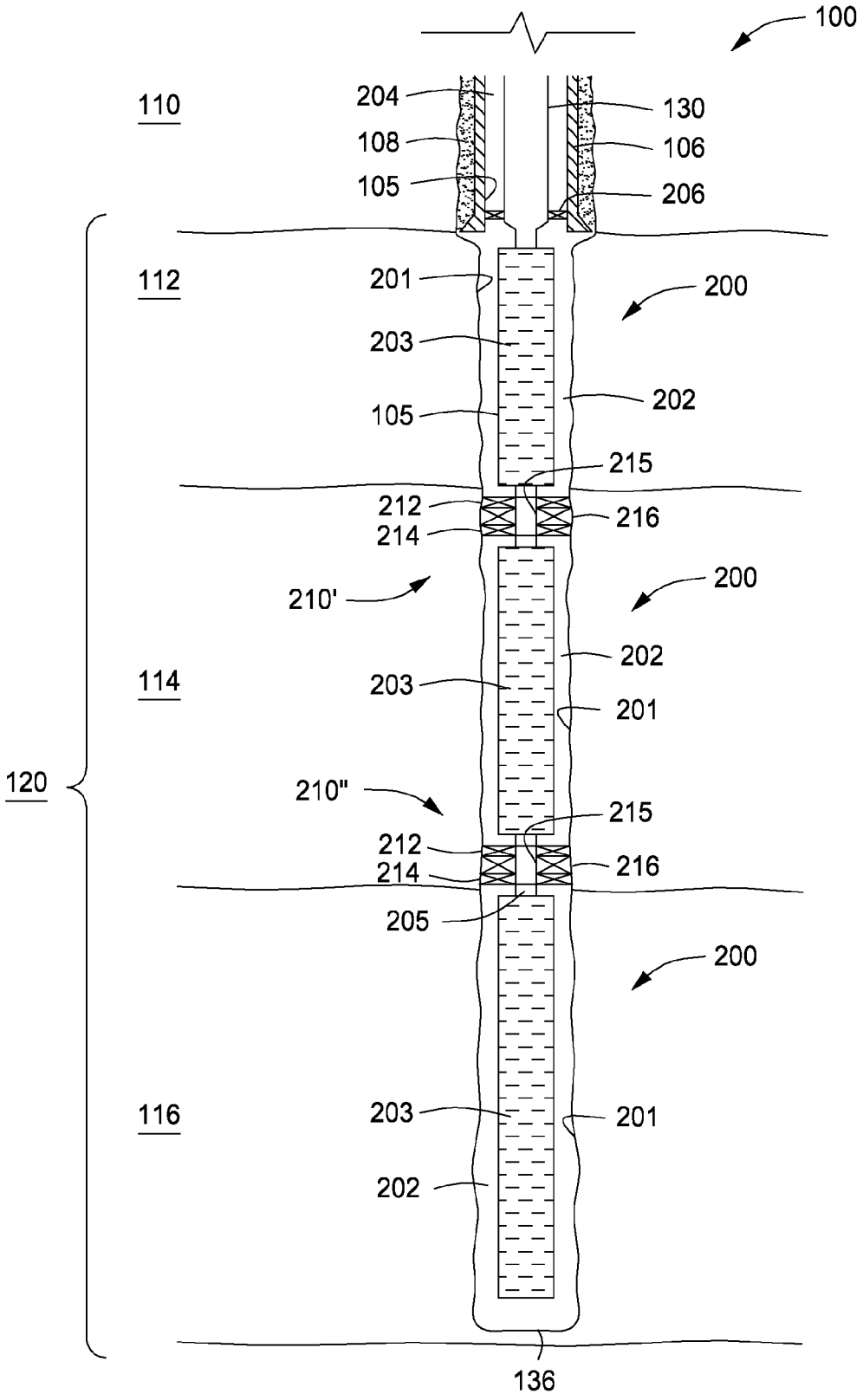
FIG. 2 is an enlarged cross-sectional view of an open-hole completion of the wellbore of FIG. 1. The open-hole completion at the depth of the three illustrative intervals is more clearly seen.

Referring now to FIG. 2, the base pipes 200 define an elongated tubular body 205. Each base pipe 205 typically is made up of a plurality of pipe joints. The base pipe 200 (or each pipe joint making up the base pipe 200) has perforations or slots 203 to permit the inflow of production fluids.

In another embodiment, the base pipes 200 are blank pipes or perforated pipes having a filter medium (not shown) wound there around. In this instance, the base pipes 200 form sand screens. The filter medium may be a wire mesh screen or wire wrap fitted around the tubular bodies 205. Alternatively, the filtering medium of the sand screen may comprise a membrane screen, an expandable screen, a sintered metal screen, a porous media made of shape-memory polymer (such as that described in U.S. Pat. No. 7,926,565), a porous media packed with fibrous material, or a pre-packed solid particle bed. The filter medium prevents the inflow of sand or other particles above a pre-determined size into the base pipe 200 and the production tubing 130.

In addition to the base pipes 200, the wellbore 100 includes one or more packer assemblies 210. In the illustrative arrangement of FIGS. 1 and 2, the wellbore 100 has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various base pipes 200 (or sand control devices) and a surrounding wall 201 of the open-hole portion 120 of the wellbore 100.

FIG. 2 provides an enlarged cross-sectional view of the open-hole portion 120 of the wellbore 100 of FIG. 1. The open-hole portion 120 and the three intervals 112, 114, 116 are more clearly seen. The upper 210' and lower 210" packer assemblies are also more clearly visible proximate upper and lower boundaries of the intermediate interval 114, respectively.

Concerning the packer assemblies themselves, each packer assembly 210', 210" may have two separate packers. In a swellable packer assembly, the packers are set chemically by fluid contact. In a mechanically-set packer assembly, the packers are set through a combination of mechanical manipulation and hydraulic forces. For illustrative purposes of this disclosure, the packers are referred to as being mechanically-set packers. The illustrative packer assemblies 210 represent an upper packer 212 and a lower packer 214. Each packer 212, 214 has an expandable portion or element fabricated from an elastomeric or a thermoplastic material capable of providing at least a temporary fluid seal against a surrounding wellbore wall 201.

The elements for the upper 212 and lower 214 packers should be able to withstand the pressures and loads associated with a production process. The elements for the packers 212, 214 should also withstand pressure load due to differential wellbore and/or reservoir pressures caused by natural faults, depletion, production, or injection. Production operations may involve selective production or production allocation to meet regulatory requirements. Injection operations may involve selective fluid injection for strategic reservoir pressure maintenance. Injection operations may also involve selective stimulation in acid fracturing, matrix acidizing, or formation damage removal.

The sealing surface or elements for the mechanically-set packers 212, 214 need only be on the order of inches in order to affect a suitable hydraulic seal. In one aspect, the elements are each about 6 inches (15.2 cm) to about 24 inches (61.0 cm) in length.

It is preferred for the elements of the packers 212, 214 to be able to expand to at least an 11-inch (about 28 cm) outer diameter surface, with no more than a 1.1 ovality ratio. The elements of the packers 212, 214 should preferably be able to handle washouts in an 8½ inch (about 21.6 cm) or 9⅞ inch (about 25.1 cm) open-hole section 120. The expandable portions of the packers 212, 214 will assist in maintaining at least a temporary seal against the wall 201 of the intermediate interval 114 (or other interval) as pressure increases during completion, production or injection.

The upper 212 and lower 214 packers are set prior to production. The packers 212, 214 may be set, for example, by sliding a release sleeve. This, in turn, allows hydrostatic pressure to act downwardly against a piston mandrel. The piston mandrel acts down upon a centralizer and/or packer elements, causing the same to expand against the wellbore wall 201. The elements of the upper 212 and lower 214 packers are expanded into contact with the surrounding wall 201 so as to straddle the annular region 202 at a selected depth along the open-hole completion 120. PCT Patent Appl. No. WO2012/082303 entitled "Packer for Alternate Flow Channel Gravel Packing and Method for Completing a Wellbore" describes a packer that may be mechanically set within an open-hole wellbore. This PCT application, published Jun. 21, 2102, is referred to and incorporated in its entirety herein by reference.

FIG. 2 shows a mandrel at 215 in the packers 212, 214. This may be representative of the piston mandrel, and other mandrels used in the packers 212, 214 as described more fully in the WO2012/082303 PCT application. The mandrels form part of a primary flow path for production fluids.

As a "back-up" to the expandable packer elements within the upper 212 and lower 214 packers, the packer assemblies 210', 210" may also include an intermediate packer element 216. The intermediate packer element 216 defines a swelling elastomeric material fabricated from synthetic rubber compounds. Suitable examples of swellable materials may be found in Easy Well Solutions' Constrictor™ or Swell-Packer™, and SwellFix's E-ZIP™. The swellable packer 216 may include a swellable polymer or swellable polymer material, which is known by those skilled in the art and which may be set by one of a conditioned drilling fluid, a completion fluid, a production fluid, an injection fluid, a stimulation fluid, or any combination thereof.

It is noted that a swellable packer 216 may be used alone or in lieu of the upper 212 and lower 214 packers. The present inventions are not limited by the presence or design of any packer assembly unless expressly so stated in the claims.

The upper 212 and lower 214 packers may generally be mirror images of each other, except for the release sleeves that shear respective shear pins or other engagement mechanisms. Unilateral movement of a setting tool (not shown) will allow the packers 212, 214 to be activated in sequence or simultaneously. The lower packer 214 is activated first, followed by the upper packer 212 as a mechanical shifting tool is pulled upward through an inner mandrel.

The packer assemblies 210', 210" help control and manage fluids produced from different zones. In this respect, the packer assemblies 210', 210" allow the operator to seal off an interval from either production or injection, depending on well function. Installation of the packer assemblies 210', 210" in the initial completion allows an operator to shut-off the production from one or more zones during the well lifetime to limit the production of water or, in some instances, an undesirable non-condensable fluid such as hydrogen sulfide.

It is necessary to connect the packer assemblies 210', 210" to the base pipes 200. It is further necessary to connect sections of base pipe (or sand screen joints) together in series to form a sand screen assembly. These operations may be done using a unique coupling assembly (shown at 501 in FIG. 5B) that employs a load sleeve (shown at 700 in FIGS. 3 and 7A), a torque sleeve (shown at 800 in FIGS. 3 and 7A), and an intermediate coupling joint (shown at 500 in FIGS. 3 and 5A). These features are seen in operation together in FIG. 3.

Figure 3:
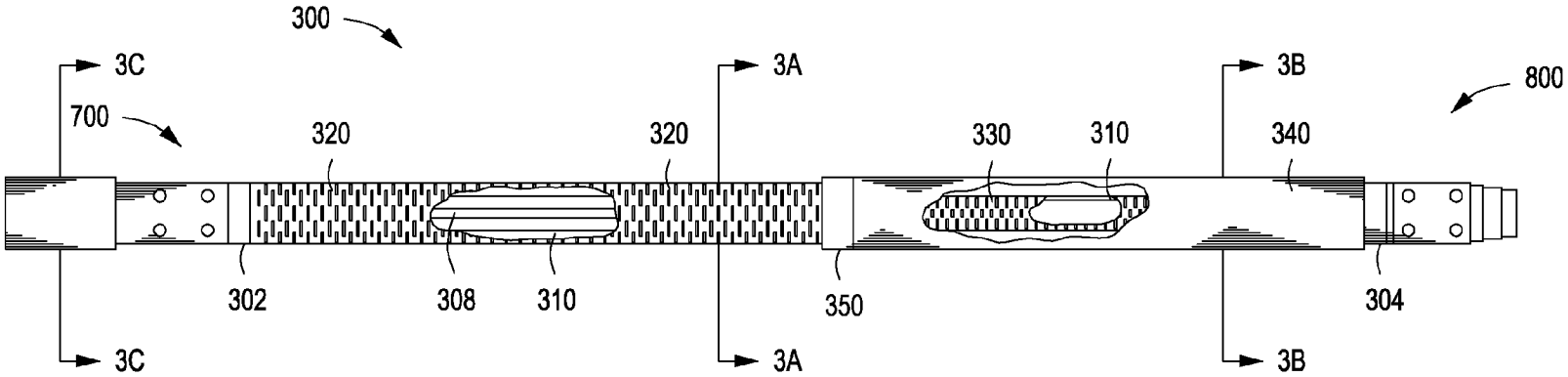
FIG. 3 presents a side view of a joint assembly of the present invention, in one embodiment. The joint assembly includes a load sleeve, a torque sleeve and an intermediate sand screen.

FIG. 3 offers a side view of a joint assembly 300 as may be used in the wellbore completion apparatus of the present invention, in one embodiment. The joint assembly 300 is intended to represent one or more joints of sand screen, forming a sand screen assembly. The joint assembly generally represents an extended base pipe 310 surrounded by primary 320 and secondary 330 filter media, or conduits.

The base pipe 310 is preferably a series of blank pipe joints. The base pipe 310 defines a tubular body having a bore 315 therein. Each pipe joint may be between 10 feet (3.05 meters) and 40 feet (12.19 meters). A bore 315 within the base pipe 310 joints serves as a primary flow path for production fluids.

Along the base pipe 310, a primary filtering conduit 320 is first seen. The primary filtering conduit 320 represents a wire mesh screen or other device that filters particles of a pre-determined size. The filtering medium for the filtering conduit 320 may be a wire wrapped screen. Alternatively, the filtering medium for the conduit 320 may be a ceramic screen. Ceramic screens are available from ESK Ceramics GmbH & Co. of Germany. The screens are sold under the trade name PetroCeram®. In any embodiment, the conduit 320 creates a matrix that permits an ingress of formation fluids while restricting the passage of sand particles over a certain gauge.

Figure 3C:
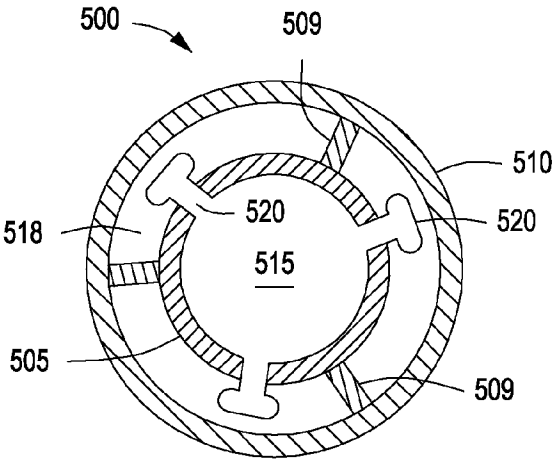
FIG. 3C is still another cross-sectional view of the joint assembly of FIG. 3. The section is taken across line 3C-3C of FIG. 3, and shows features of a coupling joint of FIG. 5.
Figure 3B:
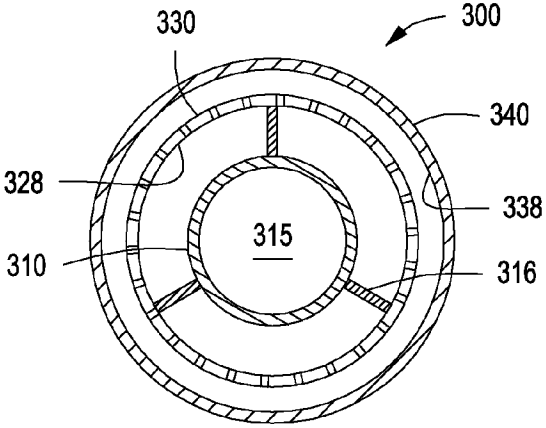
FIG. 3B is another cross-sectional view of the joint assembly of FIG. 3. The section is taken across line 3B-3B of FIG. 3, and shows features of the secondary filtering conduit.
Figure 3A:
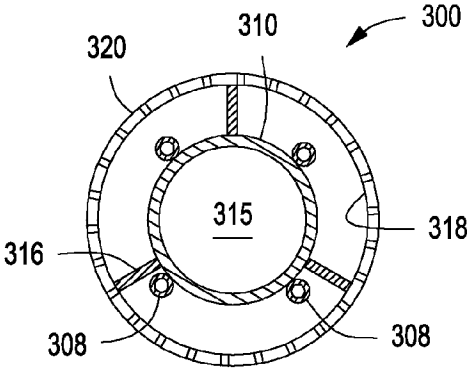
FIG. 3A is a cross-sectional view of the joint assembly of FIG. 3. The section is taken across line 3A-3A of FIG. 3, and shows features of the primary filtering conduit.

FIG. 3A is a cross-sectional view of the joint assembly 300 of FIG. 3, taken across line 3A-3A of FIG. 3. Specifically, the view is taken through the base pipe 310 along the primary filtering conduit 320. It is seen that the filtering conduit 320 resides generally concentrically about the base pipe 310. Production fluids such as hydrocarbon fluids travel through the filter medium 320 and into an annular region 318. The annular region 318 is referred to herein as a "first" annular region.

Transport conduits 308 are also seen residing around the base pipe 310. The configuration of the transport conduits 308 may be either concentric or eccentric. The transport conduits 308 are used for the transport of production fluids during a hydrocarbon recovery operation. In the arrangement of FIG. 3A, four transport conduits 308 are shown; however, it is understood that only one, or maybe up to six, transport conduits 308 may be employed.

FIG. 3B provides another cross-sectional view of the joint assembly 300 of FIG. 3. Here, the cut is taken across line 3B-3B of FIG. 3, which is through a secondary filtering conduit 330. The secondary filtering conduit 330 resides laterally adjacent to the primary filtering conduit 320.

In FIG. 3B, the base pipe 310 is again seen. In addition, a filtering medium for conduit 330 is shown. The filtering medium for the filtering conduit 330 may again be a wire wrapped screen, ceramic screen, a wire mesh, or any other medium the creates a matrix that permits an ingress of formation fluids while restricting the passage of sand particles over a certain gauge.

An annular region is formed between the base pipe 310 and the surrounding secondary filtering conduit 330. This is referred to herein as the second annular region 328. It is observed here that no transport conduits reside within this second annular region 328, although this is an optional feature that may be added. In addition, an annular region is formed between the secondary filtering conduit 330 and a surrounding blank conduit, or pipe 340. This is referred to herein as the third annular region 338.

Referring back to FIG. 3, an in-flow ring 350 is provided between the primary 320 and secondary 330 filtering conduits. The in-flow ring 350 controls the flow of production fluids from the first annular region 318 into the third annular region 338.

Figure 4:
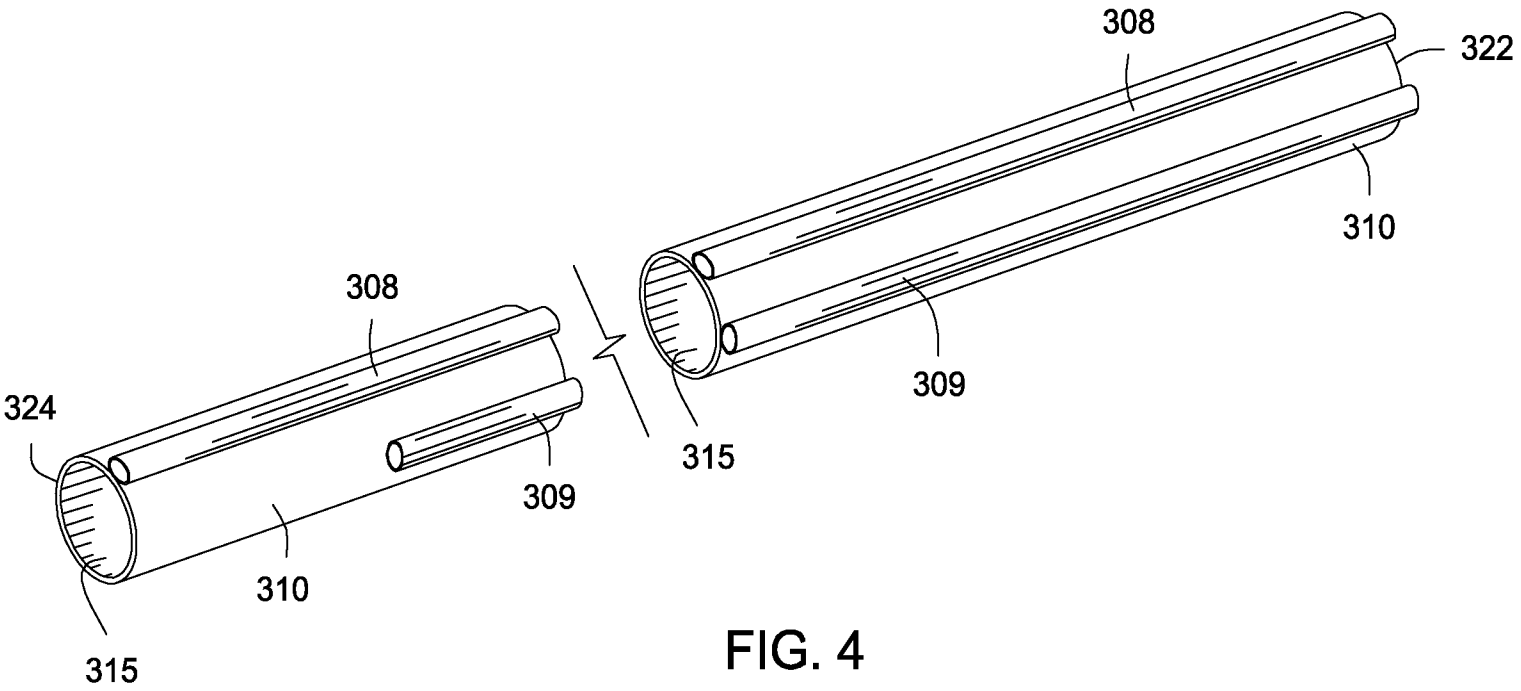
FIG. 4 is a perspective view of a base pipe taken from the joint assembly of FIG. 3. Transport conduits are shown extending along an outer diameter of the base pipe.

It is observed that the transport conduits 308 extend along the base pipe 310, but only within the first annular region 318. FIG. 4 offers a view of the base pipe 310 of FIGS. 3 and 3A. The transport conduits 308 are shown extending along the outer diameter of the base pipe 310. Two transport conduits, labeled 309, are shown optionally terminating along the length of the base pipe 310. The conduits 308, 309 are preferably constructed from steel, such as a lower yield, weldable steel. The transport conduits 308, 309 are designed to carry a fluid. If the wellbore is formed for a producer, the fluid will be hydrocarbon fluids. Alternatively, the fluid may be a treatment fluid for conditioning the formation, such as an acid solution. If the wellbore is formed for injection, the fluid will be an aqueous fluid.

Referring back to FIG. 3, the joint assembly 300 has a first or downstream end 302 and a second upstream end 304. A load sleeve 700 is operably attached at or near the first end 302, while a torque sleeve 800 is operably attached at or near the second end 304. The sleeves 700, 800 are preferably manufactured from a material having sufficient strength to withstand the contact forces achieved during running operations. One preferred material is a high yield alloy material such as S165M.

Figure 7A:
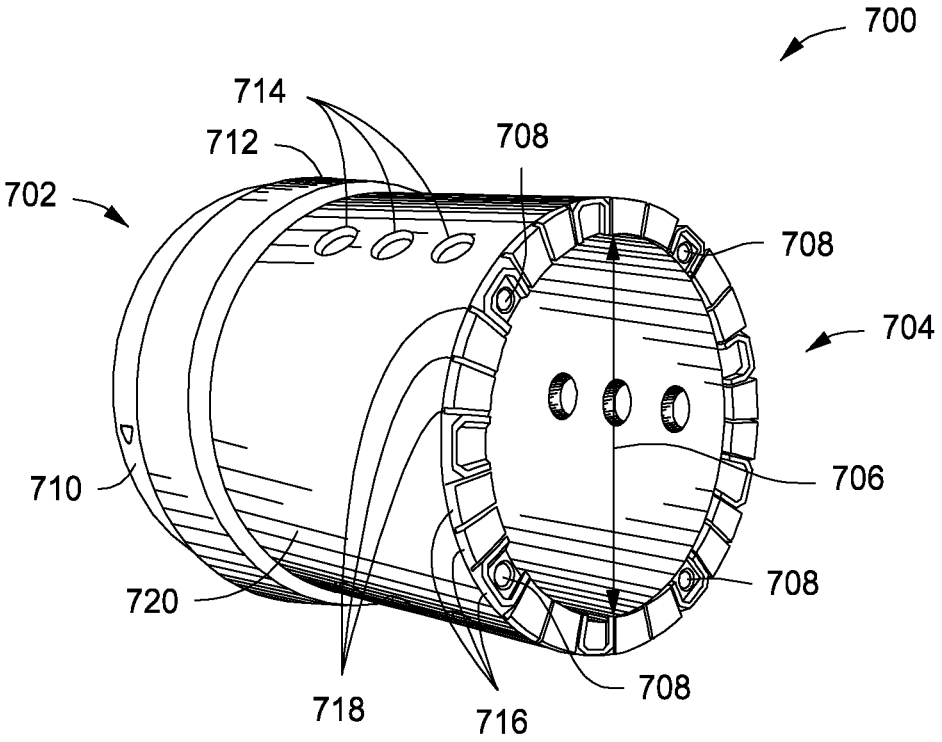
FIG. 7A is an isometric view of a load sleeve as utilized as part of the joint assembly of FIG. 6A, in one embodiment.
Figure 7B:
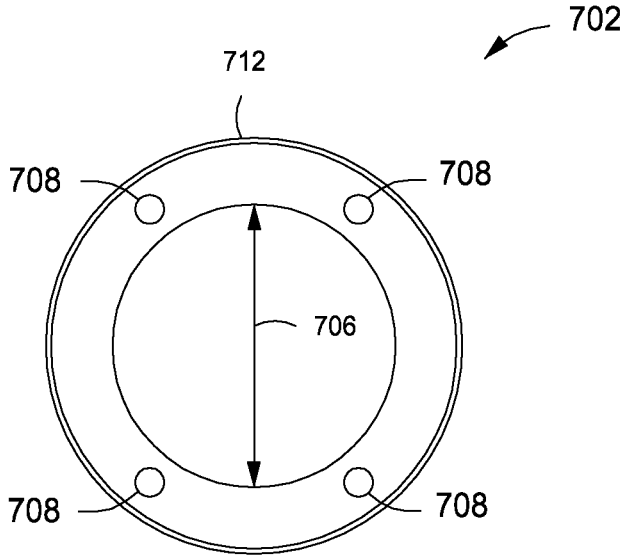
FIG. 7B is an end view of the load sleeve of FIG. 7A.

FIG. 7A is an isometric view of a load sleeve 700 as utilized as part of the joint assembly of FIG. 3, in one embodiment. FIG. 7B is an end view of the load sleeve 700 of FIG. 7A. As can be seen, the load sleeve 700 comprises an elongated body 720 of substantially cylindrical shape. The load sleeve 700 has an outer diameter and a bore extending from a first upstream end 702 to a second downstream end 704.

The load sleeve 700 includes at least two transport channels 708. The transport channels 708 are disposed within the body 720 of the sleeve 700. The transport channels 708 are in fluid communication with transport conduits 308 of FIGS. 3A and 4.

In some embodiments of the present techniques, the load sleeve 700 includes beveled edges 716 at the downstream end 704 for easier welding of the transport conduits 708 thereto. The preferred embodiment also incorporates a plurality of radial slots or grooves 718 in the face of the downstream or second end 704.

Preferably, the load sleeve 700 includes radial holes 714 between its downstream end 704 and a load shoulder 712. The radial holes 714 are dimensioned to receive threaded connectors, or bolts (shown schematically in FIG. 6). The connectors provide a fixed orientation between the load sleeve 700 and the base pipe 310. For example, there may be nine holes 714 in three groups of three spaced substantially equally around the outer circumference of the load sleeve 700 to provide the most even distribution of weight transfer from the load sleeve 700 to the base pipe 310.

Figure 8:
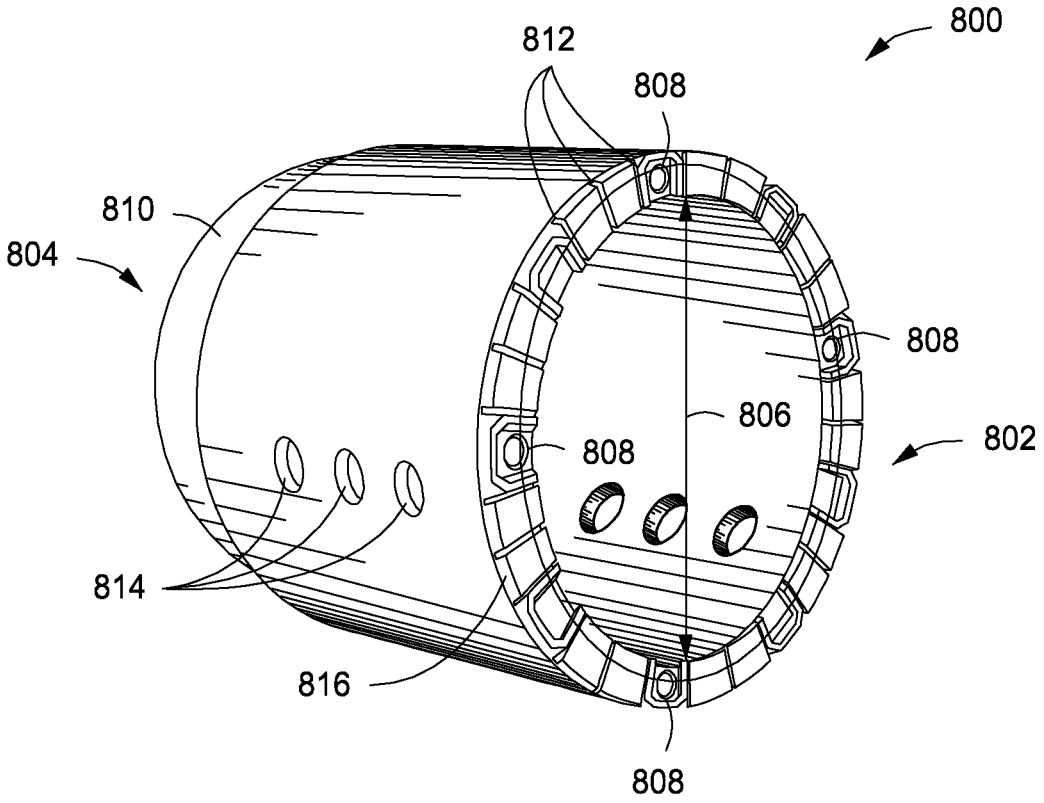
FIG. 8 is a perspective view of a torque sleeve as utilized as part of the joint assembly of FIG. 6A, in one embodiment.

Referring next to FIG. 8, FIG. 8 is a perspective view of a torque sleeve 800 utilized as part of the joint assembly 300 of FIG. 3A, in one embodiment. The torque sleeve 800 is positioned at the downstream or second end 304 of the illustrative assembly 300.

The torque sleeve 800 includes an upstream or first end 802 and a downstream or second end 804. The torque sleeve 800 also has an inner diameter 806. The torque sleeve 800 further has various alternate path channels, or transport conduits 808. The transport conduits 808 extend from the first end 802 to the second end 804. The transport conduits 808 are also in fluid communication with the transport conduits 308 of FIGS. 3A and 4.

Preferably, the torque sleeve 800 includes radial holes 814 between the upstream end 802 and a lip portion 810 to accept threaded connectors, or bolts, therein. The connectors provide a fixed orientation between the torque sleeve 800 and the base pipe 310. For example, there may be nine holes 814 in three groups of three, spaced equally around the outer circumference of the torque sleeve 800. In the embodiment of FIG. 8, the torque sleeve 800 has beveled edges 816 at the upstream end 802 for easier attachment of the transport conduits 808 thereto.

The load sleeve 700 and the torque sleeve 800 enable immediate connections with packer assemblies or other elongated downhole tools while aligning transport conduits 708, 308, 808. It is desirable to mechanically connect the load sleeve 700 to the torque sleeve 800. This is done through an intermediate threaded coupling joint 500.

Figure 5A:
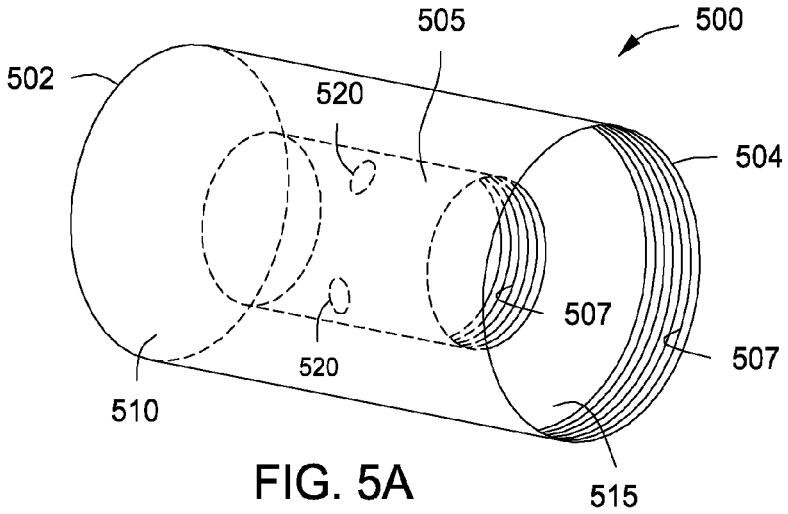
FIG. 5A is a perspective view of a coupling joint as may be used in the joint assembly of FIGS. 3 and 3C, in one embodiment.

FIG. 5A presents a perspective view of a coupling joint 500. The coupling joint 500 is a generally cylindrical body having an outer wall 510. The coupling joint 500 has a first end 502 and a second end 504. The first end 502 contains female threads (not shown) that threadedly connect to male threads of the torque sleeve 800. Similarly, the second end 504 contains female threads 507 that threadedly connect to male threads of the load sleeve 700. Alternatively, these thread type seals can be replaced by rubber seals, e.g., "O-ring" seals.

In a more preferred arrangement, the outer wall 510 defines a co-axial sleeve. Opposing ends of the co-axial sleeve have respective shoulders that land on the load sleeve 700 and the torque sleeve 800.

Interior to the coupling joint 500 is a main body 505. The main body 505 defines a bore having opposing ends. The opposing ends threadedly connect to respective base pipes 310. An annular region is formed between an outer diameter of the main body 505 and an inner diameter of the outer wall 510 (the co-axial sleeve). This is referred to as a manifold 518.

Figure 5B:
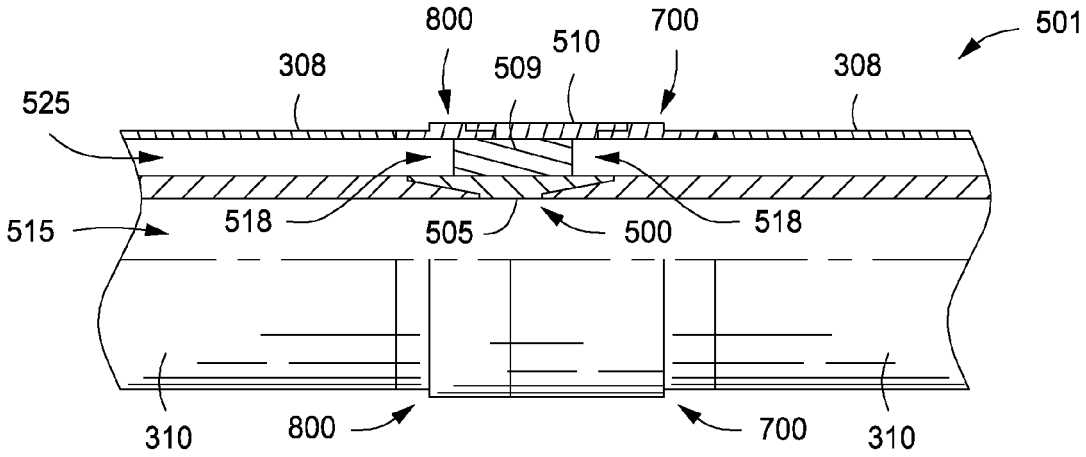
FIG. 5B is a side, schematic cut-away view of the coupling joint of FIG. 5A. Here, the coupling joint is coupled to a load sleeve and a torque sleeve, seen schematically on opposing ends of the coupling joint, to form a coupling assembly.

FIG. 5B is a side view of the coupling joint 500 of FIG. 5A. In this view, the coupling joint 500 is part of a coupling assembly 501 as may be used to connect base pipes 310 to form a sand screen assembly 300, in one embodiment. In FIG. 5B, the coupling assembly 501 includes a load sleeve 700 and a torque sleeve 800. The load sleeve 700 and the torque sleeve 800 are connected by means of the intermediate coupling joint 500.

FIG. 5B shows a primary flow path at 515 and a secondary flow path at 525. The primary flow path 515 represents a flow path through the bore of the base pipes 310, the bore of the load sleeve 700, the bore of the main body 505, and the bore of the torque sleeve 800. The secondary flow path 525, in turn, represents a flow path through the transport channels 708 of the load sleeve 700, the manifold 518 of the coupling joint 500 and the transport channels 808 in the torque sleeve 800. Additionally, the secondary flow path includes transport conduits 308 residing external to the base pipes 310 and within the first annular region 318.

FIG. 3C is a cross-sectional view of the coupling joint 500 of FIG. 3 and FIG. 5A, taken across line 3C-3C of FIG. 3A. In FIG. 3C, the manifold 518 is more clearly seen. The coupling joint 500 offers a plurality of torque spacers 509. The torque spacers 509 support the annular region, or manifold 518, between the main body 505 and the surrounding co-axial sleeve 510. Stated another way, the torque spacers 509 provide structural integrity to the co-axial sleeve 510 to provide a substantially concentric alignment with the main body 505.

In the present invention, the coupling joint 500 further includes one or more flow ports 520. These are seen in both FIGS. 5A and 3C. The flow ports 520 provide fluid communication between the inner bore defined by 515 (part of the primary flow path) and the transport conduits 308 (part of the secondary flow path). In the view of FIG. 3C, three separate flow ports 520 are provided.

Additional details concerning the load sleeve 700, the torque sleeve 800 and the coupling joint 500 are provided in U.S. Pat. No. 7,938,184. The '184 patent is entitled "Wellbore Method and Apparatus for Completion, Production and Injection," and issued in 2011. FIGS. 3A, 3B, 3C, 4A, 4B, 5A, 5B, 6 and 7 present details concerning components of a joint assembly in the context of using a sand screen. These figures and accompanying text are incorporated herein by reference.

As noted, the base pipe 310 is designed to be run into an open-hole portion of a wellbore. The base pipe 310 is ideally run in pre-connected sand screen joints that are threadedly connected. Sections of pre-connected joints are then connected at the rig using a coupling assembly, such as the assembly 501 of FIG. 5B. The coupling assembly 501 will preferably include a load sleeve, such as the load sleeve 700 of FIGS. 7A and 7B, a torque sleeve, such as the torque sleeve 800 of FIG. 8, and an intermediate coupling joint, such as the coupling joint 500 of FIG. 5A.

Figure 6:
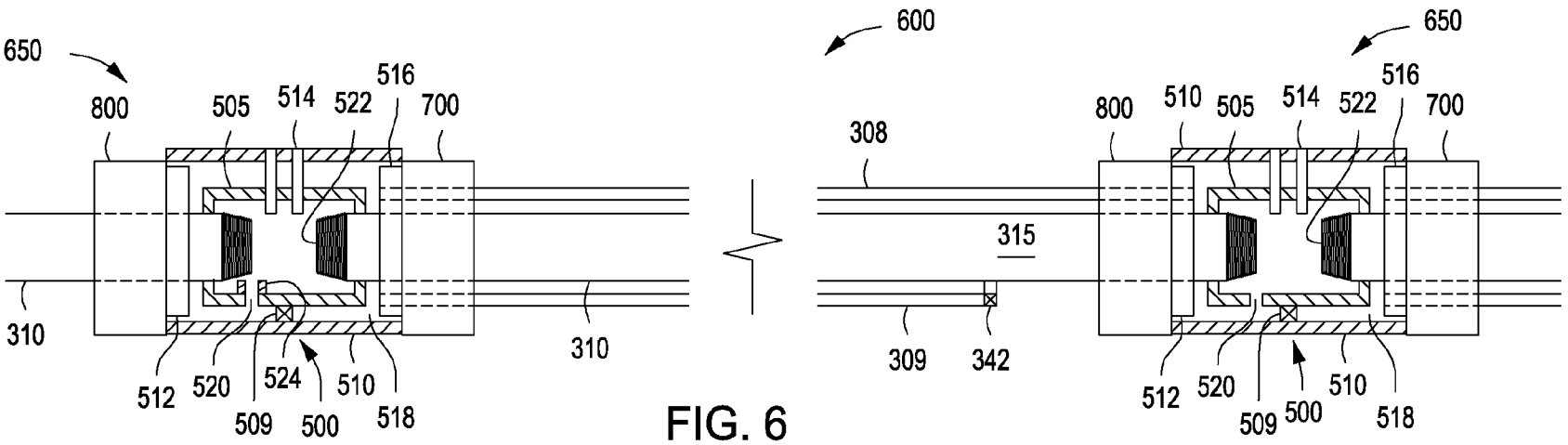
FIG. 6 is a side schematic view of a sand screen assembly as may be used in the present invention, in one embodiment. The assembly shows a pair of coupling assemblies at opposing ends of a sand screen. Flow ports are seen in each of the coupling joints.

FIG. 6 presents a side, cut-away view of a joint assembly 600 of the present invention, in one arrangement. In FIG. 6, a base pipe 310 is seen. The base pipe 310 includes transport conduits 308, 309 in accordance with base pipe 310 of FIG. 4 described above. At opposing ends of the base pipe 310 are coupling assemblies 650. Each of the coupling assemblies 650 is configured to have a coupling joint 500. The coupling joint 500 includes a main body 505 and a surrounding co-axial sleeve 510 in accordance with FIG. 5A. Additionally, the coupling joint 500 includes a manifold region 518 and at least one flow port 520 in accordance with FIG. 3C.

Additional features of the coupling joint 500 include a torque spacer 509 and optional bolts 514. The torque spacer 509 and bolts 514 hold the main body 505 in fixed concentric relation relative to the co-axial sleeve 510. Also, an in-flow control device 524 is shown. The inflow control device 524 allows the operator to selectively open, partially open, close or partially close a valve associated with the flow port(s) 520. This may be done, for example, by sending a tool downhole on a wireline or an electric line or on coiled tubing that has generates a wireless signal. The signal may be, for example, a Bluetooth signal or an Infrared (IR) signal. The in-flow control device 524 may be, for example, a sliding sleeve or a valve. In one aspect, the flow port is itself an in-flow control device, e.g., a nozzle.

The coupling assemblies 650 also each have a torque sleeve 800 and a load sleeve 700. The torque sleeve 800 and the load sleeve 700 enable connections with the base pipe 310 while aligning shunt tubes. U.S. Pat. No. 7,661,476, entitled "Gravel Packing Methods," discloses a production string (referred to as a joint assembly) that employs a series of sand screen joints. The sand screen joints are placed between a "load sleeve" and a "torque sleeve." The '476 patent is incorporated by reference herein in its entirety.

To provide a fluid seal along the coupling assemblies 650, o-rings 512, 516 are provided. An o-ring 512 resides along a shoulder between the torque sleeve 800 and the connected coupling joint 500, while an o-ring 514 resides along a shoulder between the load sleeve 700 and the connected coupling joint 500.

In FIG. 6, the transport conduit 309 has a shortened length. At the end of the shortened transport conduit is an optional valve 342. The valve 342 allows an operator to selectively open and close fluid flow from the transport conduit 309. This again may be done by sending a tool downhole on a wireline or an electric line or on coiled tubing that has generates a wireless signal.

In open hole completions, it is desirable to employ a filtering media around the base pipe 310. Further, it is desirable for the filtering media to provide an indirect flow path, thereby minimizing the likelihood of so-called hot spots, or areas of higher fluid flow cause, for example, by screen failure, along the filtering media. WO 2013/055451 entitled "Fluid Filtering Device for a Wellbore and Method for Completing a Wellbore" describes a filter media that provides an indirect flow path. That application was filed internationally on Aug. 23, 2012, and is referred to and incorporated herein in its entirety, by reference.

U.S. Ser. No. 14/188,565 entitled "Sand Control Screen Having Improved Reliability" also describes a sand screen having filtering media that create an indirect flow path for production fluids. Various modifications to the filtering media are offered to create a sand screen assembly, in various embodiments, having significantly improved reliability. That application was filed on Feb. 24, 2014 and is also referred to and incorporated herein in its entirety, by reference.

Figure 9A:
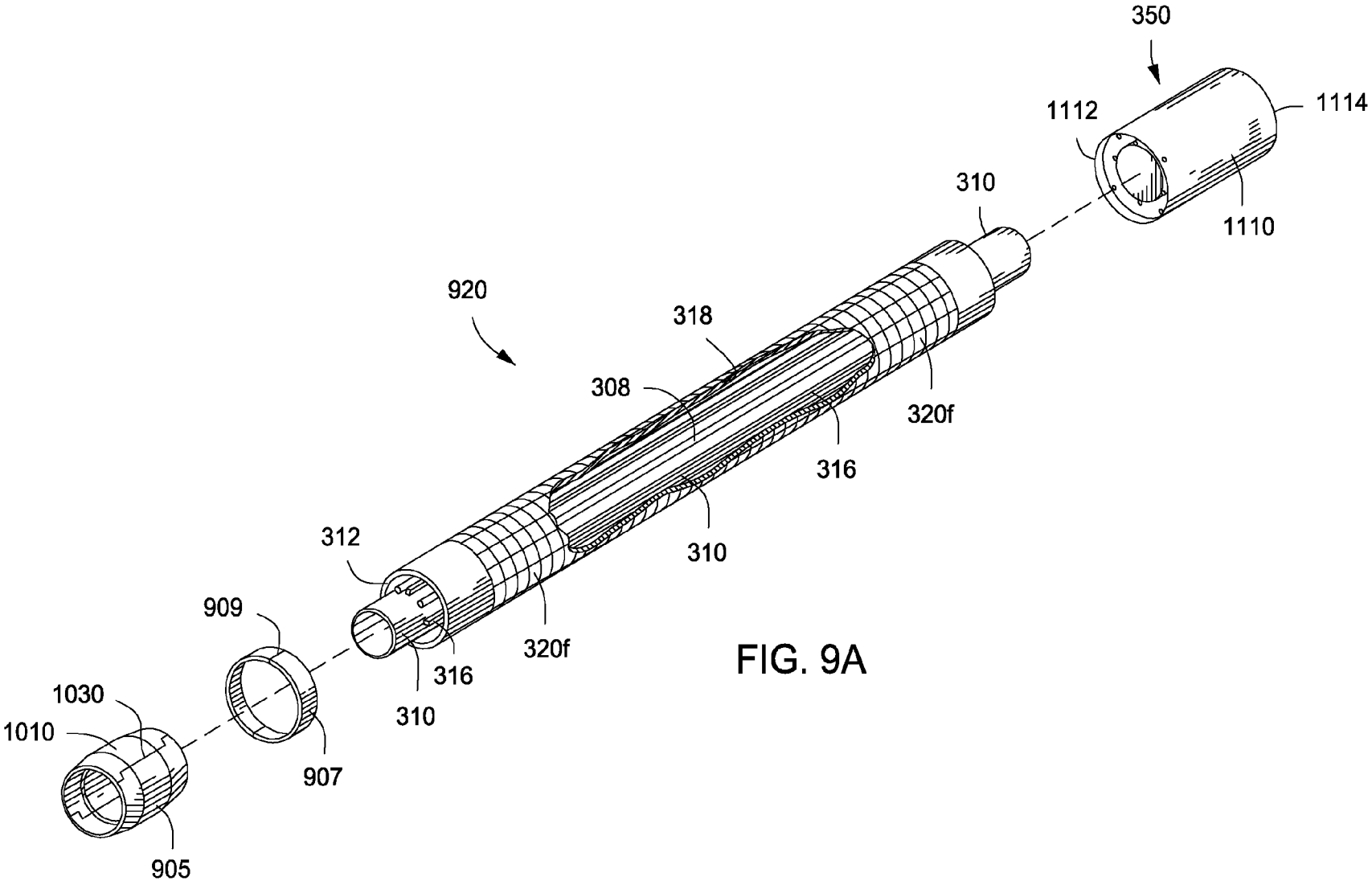
FIGS. 9A and 9B are perspective views of portions of a sand screen assembly of the of the present invention, in certain embodiments.
Figure 9B:
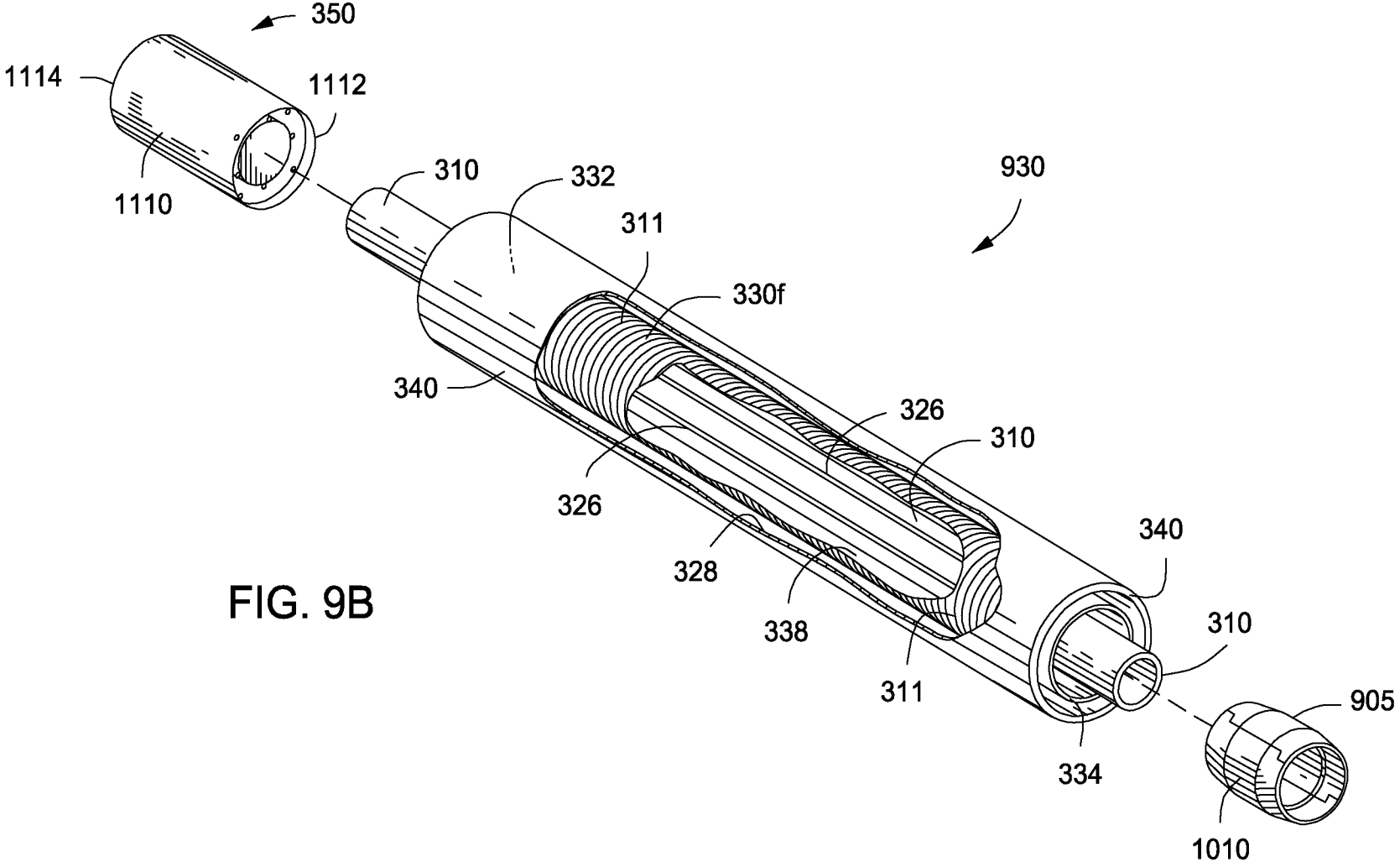

FIGS. 9A and 9B present portions of a sand screen joint as may be used in the present inventions. These portions are a modification of the sand screen 300 from FIG. 3B of U.S. Ser. No. 14/188,565 application, having transport conduits 308 added.

The sand screen joint portions of FIGS. 9A and 9B are designed to reside together, end-to-end, as part of a sand screen assembly. The assembly, in turn, may be placed in a wellbore that is completed substantially vertically, such as the wellbore 100 shown in FIG. 1. Alternatively, the sand screen assembly may be placed longitudinally along a formation that is completed horizontally or that is otherwise deviated.

The sand screen joint portions of FIGS. 9A and 9B serve as filtering sections. The filtering sections are divided into a primary section 920 (seen in FIG. 9A) and a secondary section 930 (seen in FIG. 9B).

FIG. 9A provides an exploded perspective view of a portion of a sand screen assembly, representing the primary filtering section 920. The primary section 920 first includes the elongated base pipe 310. As can be seen, this section of base pipe 310 is blank pipe.

Circumscribing the base pipe 310 is a filtering conduit 320*f*. The filtering conduit 320*f* defines a filtering medium. A portion of the filtering conduit 320*f* is cut-away, exposing the blank (non-perforated) base pipe 310 there along. In FIG. 9A, the wire mesh screen extends substantially along the length of the filtering section 320.

Longitudinal ribs 316 are also shown in the cut-away section. The ribs 316 provide clearance for the surrounding filtering conduit 320*f*. A height of the ribs 316 may be adjusted to optimize fluid flow while minimizing the presence of hot spots.

The filtering conduit 320*f* is placed around the base pipe 310 in a substantially concentric manner. Extending along the first annular region 318 with the first filtering section 320 are transport conduits 308. Thus, the conduits 308 reside below the filtering conduit 320*f*.

In the arrangement of FIG. 9A, the primary section 320 includes an optional split ring 905. The split-ring 905 is dimensioned to be received over the base pipe 310, and then abut against a first end 312 of the primary filtering section 920.

Figure 10B:
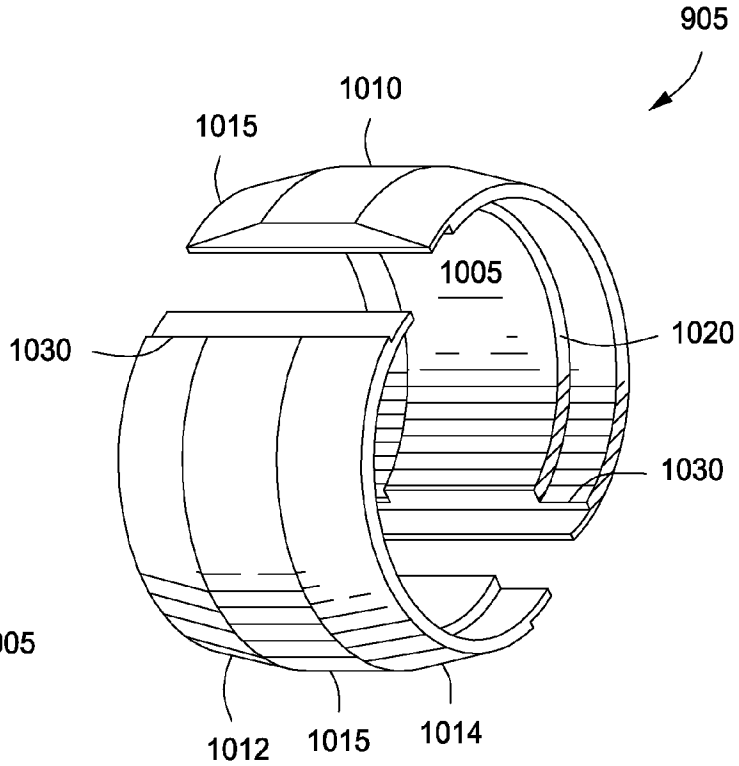
FIG. 10B is a perspective view of the split-ring of FIG. 10A. The split-ring is shown as being separated along the two seams for illustrative purposes.
Figure 10A:
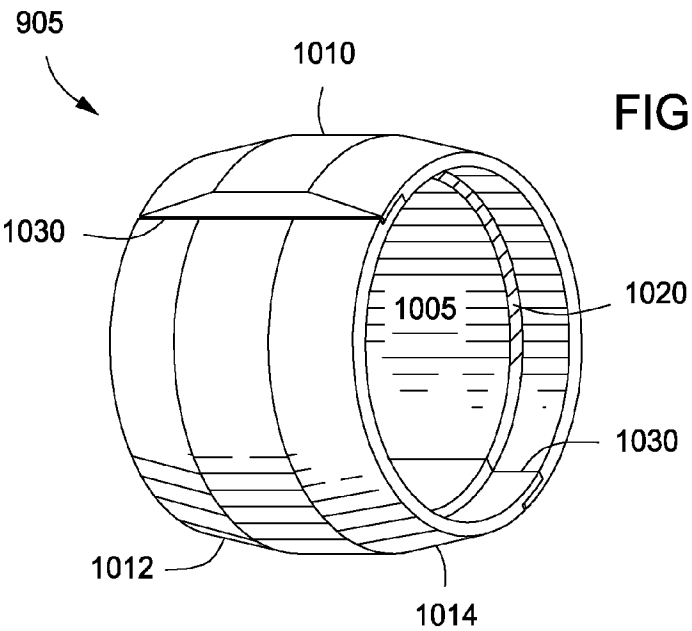
FIG. 10A is a perspective view of a split-ring as may be used for connecting components of the sand screen of FIGS. 9A and 9B. The illustrative split-ring has two seams.
Figure 10C:
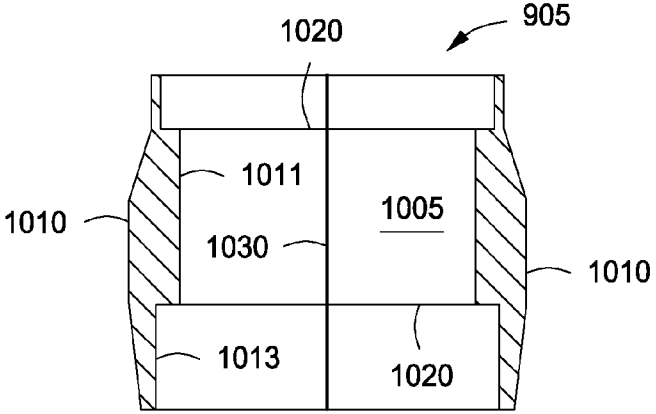
FIG. 10C is a cross-sectional view of the split-ring of FIG. 10A, taken across the length of the ring.

FIG. 10A provides an enlarged perspective view of the split-ring 905 of FIG. 15A. The illustrative split-ring 905 defines a short tubular body 1010, forming a bore 1005 there through. FIG. 10B presents another perspective view of the split-ring 905 of FIG. 10A. Here, the split-ring 905 is shown as separated along two seams 1030. FIG. 10C is a cross-sectional view of the split-ring 905 of FIG. 10A, taken across the minor axis. Additional details concerning the split-ring 905 are provided in U.S. Ser. No. 14/188,565 and need not be repeated herein.

FIG. 9A also shows a welding ring 907. The welding ring 907 is an optional circular body that offers additional welding stock. In this way, the filtering conduit 320*f* may be sealingly connected to the split ring 905. The welding ring 907 may have seams 909 that allow the welding ring 907 to be placed over the tubular body 310 for welding.

The other portion of the sand screen assembly mentioned above is the secondary filtering section 930. This is discussed in connection with FIG. 9B.

FIG. 9B is an exploded perspective view of the secondary filtering section 930. The secondary filtering section 930 also includes the elongated base pipe 310. Circumscribing the base pipe 310 is a secondary filtering conduit 330*f*. The filtering conduit 330*f* also serves as a filtering medium. A portion of the filtering conduit 330*f* is cut-away, exposing the base pipe 310 there-along. The filtering medium of the illustrative filtering conduit 330*f* is a wire-wrapped screen, although it could alternatively be a wire-mesh. In this instance, the wire-wrapped screen provides a plurality of small helical openings 1421. The helical openings 1421 are sized to permit an ingress of formation fluids while restricting the passage of sand particles over a certain gauge.

Longitudinal ribs 326 are provided along the base pipe 310. The ribs 326 provide a determined spacing or height between the base pipe 310 and the surrounding secondary filtering conduit 330*f*. Adjustment of the height of the ribs 326 adjusts the flow rate along the base pipe 310 in the second annular region 328. One or more transport conduits may be incorporated in the second annular region 328, like transport conduit 308 in the first annular region 318 as shown in FIG. 9A.

Separating the first filtering section 920 from the second filtering section 930 is an in-flow ring 350. The in-flow ring 350 is seen in both FIGS. 9A and 9B, exploded apart from the base pipe 310.

Figure 11A:
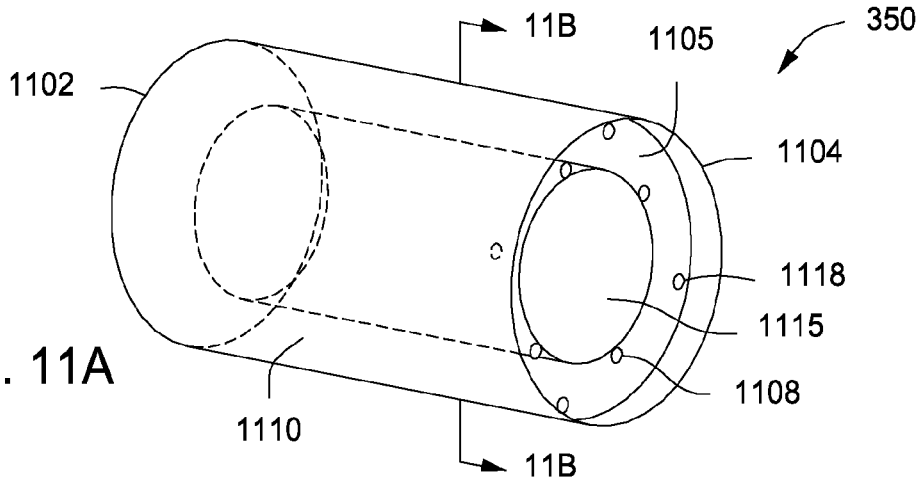
FIG. 11A is a perspective view of an in-flow ring as may be used for directing production fluids between primary and the secondary filtering sections for the sand screen of FIGS. 9A and 9B.

FIG. 11A provides a perspective view of an in-flow ring 350 as may be used for directing production fluids along the primary and the secondary flow paths for the sand screen portions of FIGS. 9A and 9B. As shown in FIG. 11A, the in-flow ring 350 defines a cylindrical body 1110. The body 1110 is thick, forming a wall having an outer diameter and an inner diameter of the body 1110.

The body 1110 has a first end 1102 and a second end 1104. Intermediate these ends 1102, 1104 the in-flow ring 350 defines a central bore 1115. The central bore 1115 is dimensioned to closely receive a base pipe 310. The central bore 1115 preferably includes a gasket or other sealing member (not shown) for providing a seal with the outer diameter of a base pipe 310. The in-flow ring 350 is disposed along a base pipe 310 and is preferably welded into place between primary 920 and secondary 930 filtering sections.

Figure 11B:
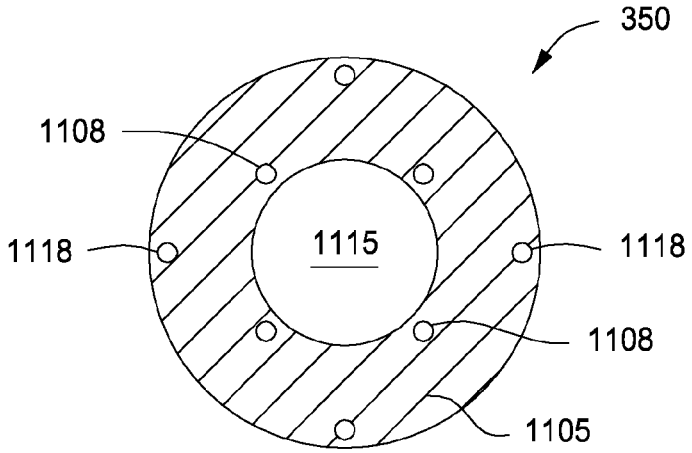
FIG. 11B is a cross-sectional view of the in-flow ring of FIG. 11A. The section is taken across lines 11B-11B of FIG. 11A. Primary and secondary flow conduits are shown.

FIG. 11B is a cross-sectional view of the in-flow ring 350 of FIG. 11A. The section is taken across lines 11B-11B of FIG. 11A. In FIG. 11B, it can be seen that sets of flow conduits are shown. These represent primary 1118 and secondary 1108 flow channels.

In operation, formation fluids will flow from a subsurface formation and into a wellbore that houses the sand screen assembly 300. The fluids will pass through the matrix forming the primary filtering conduit 320*f* and into the first annular region 318. The fluids will then flow through one or more primary in-flow channels 1118 in the in-flow ring 350 and into the third annular region 338. From there, formation fluids will pass through the matrix forming the secondary filtering conduit 330*f* and into the second annular region 328. Thereafter, fluids will flow back through the secondary in-flow channels 1108 in the in-flow ring 350 and into one or more transport conduits 308. As noted, the transport conduits 308 reside along the first annular region 318. The transport conduits 308 can also optionally extend along the second annular region 328.

In one aspect, the second end 1104 of the in-flow ring 350 is to be connected to the first end 332 of the filtering conduit 330*f*. Specifically, an inner diameter of the blank housing 340 is welded onto an outer diameter of the body 1110 of the in-flow ring 350. In this way, formation fluids are sealingly delivered from the first annular region 318, through the primary in-flow channels 1118, and into the third annular region 338.

The in-flow rings 350 seal the open ends of the second annular region 328. The in-flow rings 350 are welded on the pipe 310 and provide a flow transit from the first annular region 318 to the second annular region 328. The in-flow rings 350 also provide radial support for the surrounding housing 340 via welding.

To effectuate the transport of formation fluids to the surface 101, production fluids flow through the secondary in-flow conduits 1108, through the transport conduits 308, through the flow ports 520, and into the base pipes 310. The base pipes 310 are in fluid communication with the production tubing 130 (shown in FIGS. 1 and 2). The base pipes 310 and the production tubing 130 ultimately form an elongated tubular body that serves as the primary flow path.

Returning back to FIG. 9B, FIG. 9B shows the second end 324 of the filtering conduit 330*f* as being open. This allows fluid communication with another primary filtering section 320. The housing 340 is welded onto the in-flow ring 350 to seal the third annular region 338 except through the primary in-flow channels 1118. Fluids in the third annular region 338 then flow through the secondary filtering conduit 330*f* and into the second annular region 328.

Figure 11C:
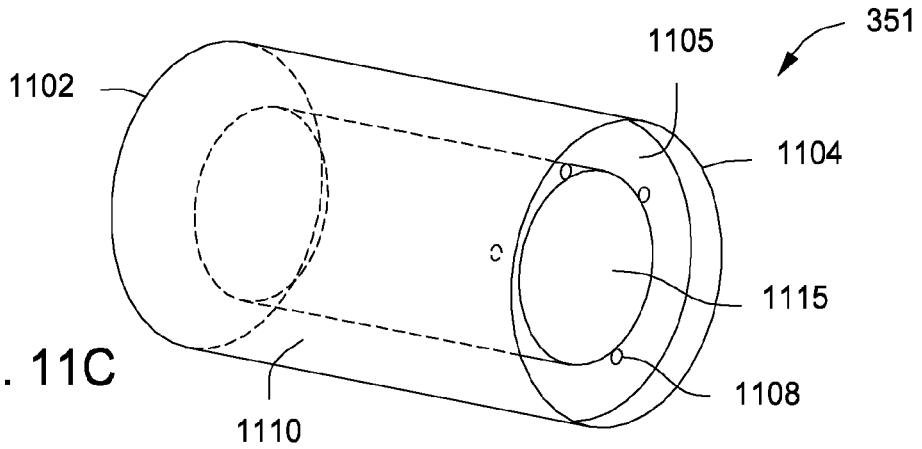
FIG. 11C is a perspective view of the in-flow ring of FIG. 11A in an alternate embodiment. Here, the primary in-flow channels have been removed.

It is observed here that the in-flow ring 350 in FIG. 9B may be modified. In this respect, the primary in-flow channels 1118 may be removed. FIG. 11C is a perspective view of the in-flow ring of FIG. 11A without the primary in-flow channels. This in-flow ring is indicated at 351. The result of this design is that the in-flow ring 351 does not allow production fluids to flow from the first annular region 318 to the third annular region 338. Note that the in-flow ring 351 does still allow production fluids from the second annular region 328 to the third annular region 338.

Figure 5C:
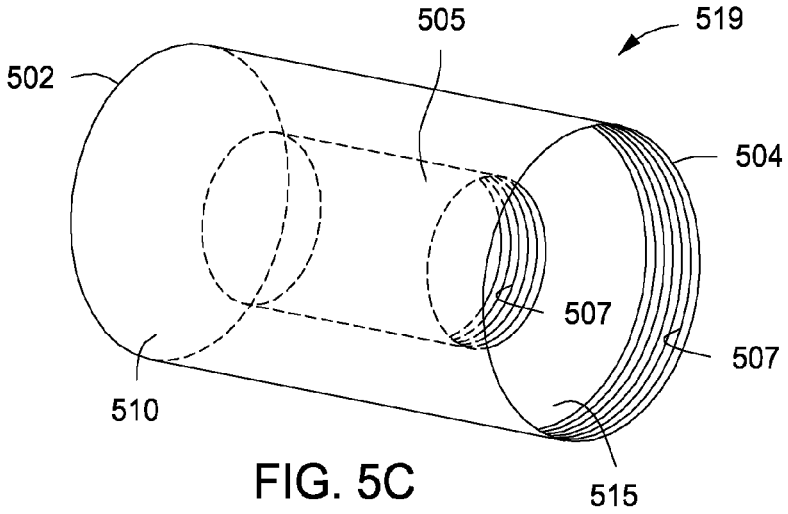
FIG. 5C is a perspective view of the coupling joint of FIG. 5A, in an alternate embodiment. Here, the flow ports have been removed.

An alternative to the in-flow ring 351 is to use the coupling joint 500 of FIG. 5A, but remove the flow ports 520. Such an arrangement is shown in FIG. 5C. FIG. 5C provides a perspective view of a coupling joint 519 without flow ports 520.

The sand control sections 920, 930 of FIGS. 9A and 9B are beneficial in preventing the encroachment of sand into the bore of production tubing, such as tubing 130. In the present disclosure, the sand screen 1400 is equipped with the transport conduits 308, 309, providing a secondary flow path for wellbore fluids. The conduits 308, 309 reside exterior to the base pipe 310, along the first filtering section 920, and between a load sleeve and a torque sleeve at opposing ends of sand screen joints.

FIGS. 12A through 12D present schematic, cross-sectional views of a portion of a sand screen assembly of the present invention, in various embodiments.

Figure 12A:
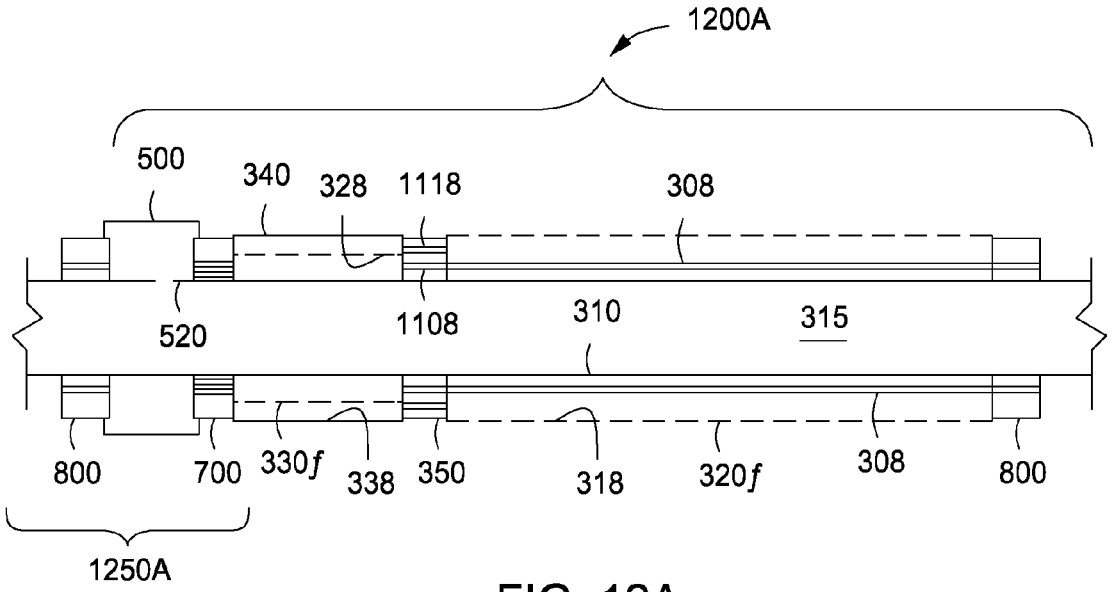
FIGS. 12A through 12D present schematic, cross-sectional views of a portion of a downhole sand control assembly of the present invention, in various embodiments.

FIG. 12A shows a portion of a sand screen assembly 1200A, in a first embodiment. This embodiment shows a single primary filtering conduit 320*f* adjacent a single secondary filtering conduit 330*f*. A blank housing 340 resides around the second filtering conduit 330*f*.

A primary flow path for fluids is shown at 315 as the bore of a base pipe 310. A secondary flow path is not shown along the base pipe 310. However, it is understood that transport conduits 308 will be used external to the bore 315. The transport conduits 308, 309 will preferably reside within filter media of the first 320*f* and second 330*f* filtering conduits.

The first annular region 318 is shown intermediate the base pipe 310 and the surrounding primary filtering conduit 320*f*. Likewise, a second annular region 328 is shown intermediate the base pipe 310 and the surrounding secondary filtering conduit 330*f*. Finally, a third annular region 338 is shown intermediate the secondary filtering conduit 330*f* and the surrounding blank housing 340.

An in-flow ring 350 is disposed between the primary 320*f* and secondary 330*f* filtering sections. The in-flow ring 350 is intended to represent ring 350 of FIG. 11A. However, it may alternatively be the in-flow ring 351, that is, in-flow ring 350 without the primary in-flow channels 1118 of FIG. 11B, as shown in FIG. 11C. This means that the in-flow ring 351 does not allow the flow of production fluids from the first annular region 318 to the third annular region 338. The in-flow ring 351 does still allow production fluids to flow from the second annular region 328 to the third annular region 338. Another alternative to in-flow ring 351 is to use a coupling assembly which is made up of a load sleeve 700, the coupling joint 519 (from FIG. 5C), and the torque sleeve 800. This creates a coupling without the flow ports 520.

A coupling joint assembly 1250A is provided at a first end of the base pipe 310. The coupling assembly 1250A includes a torque sleeve 800, a coupling joint 500 and a load sleeve 700. The coupling joint 500 forms a manifold for communicating fluids between sand screens.

A coupling assembly (not entirely shown) is also intended to be connected at a second end of the base pipe 310. Here, the immediate connection between the coupling assembly and the second end of the base pipe 310 is by means of a torque sleeve 800. Thus, a load sleeve 700 is provided at one end and a torque sleeve 800 is provided at the opposite end. It is understood that the load sleeve 700 and the torque sleeve 800 will include flow channels (shown in FIGS. 7A and 8 at 708 and 808, respectively).

Figure 12B:
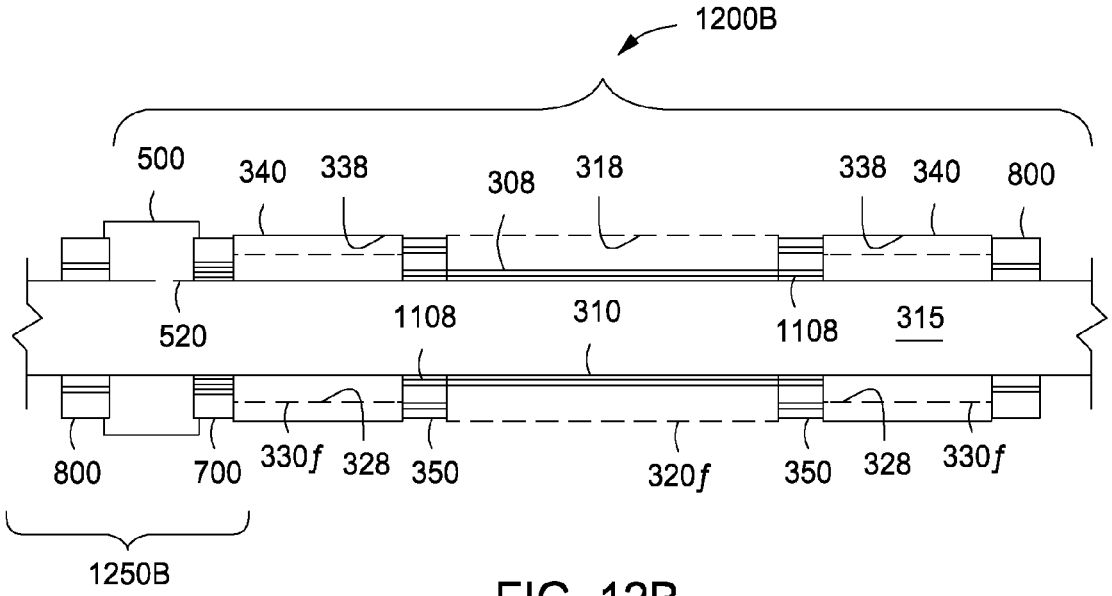

FIG. 12B shows a portion of a sand screen assembly 1200B, in an alternate embodiment. Here, an arrangement of an indirect-flow path sand screen is provided. This embodiment shows a single primary filtering conduit 320*f*, with secondary filtering conduits 330*f* on opposing sides of the primary filtering conduit 320*f*, or section. In-flow rings 350 are disposed between the primary 320*f* and secondary 330*f* filtering sections.

A primary flow path for fluids is again shown at 315. Transport conduits 308 reside external to the base pipe 310 along the first filtering section to provide a secondary flow path.

In FIG. 12B, a coupling joint assembly 1250B is provided at a first end of the base pipe 310. The coupling assembly 1250B includes a torque sleeve 800, a coupling joint 500 and a load sleeve 700. A coupling assembly is also intended to be connected at a second end of the base pipe 310. Here, the immediate connection between the coupling assembly and the second end of the base pipe 310 is by means of a torque sleeve 800. Thus, a load sleeve 700 is provided at one end and a torque sleeve 800 is provided at the opposite end.

A primary flow path for fluids is again shown at 315. Transport conduits 308 reside external to the base pipe 310 along the first filtering section to provide a secondary flow path.

Figure 12C:
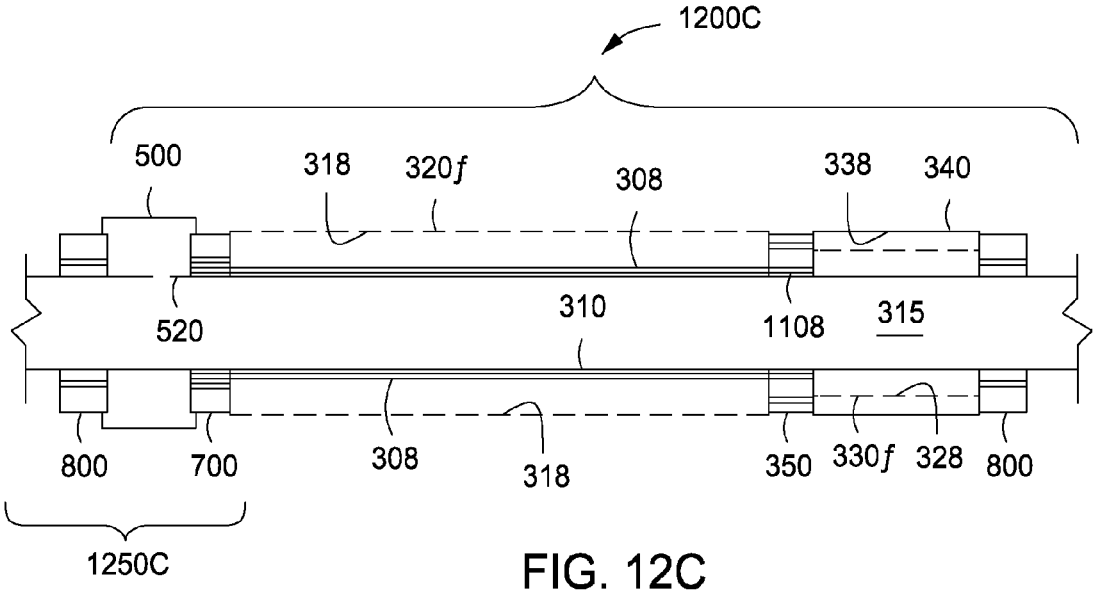

FIG. 12C shows a portion of a sand screen assembly 1200C in another alternate embodiment. Here, the location of components along the assembly 1200C relative to the assembly 1200A of FIG. 12A has been flipped. A coupling assembly 1250C is shown at a first end of the base pipe 310.

Figure 12D:
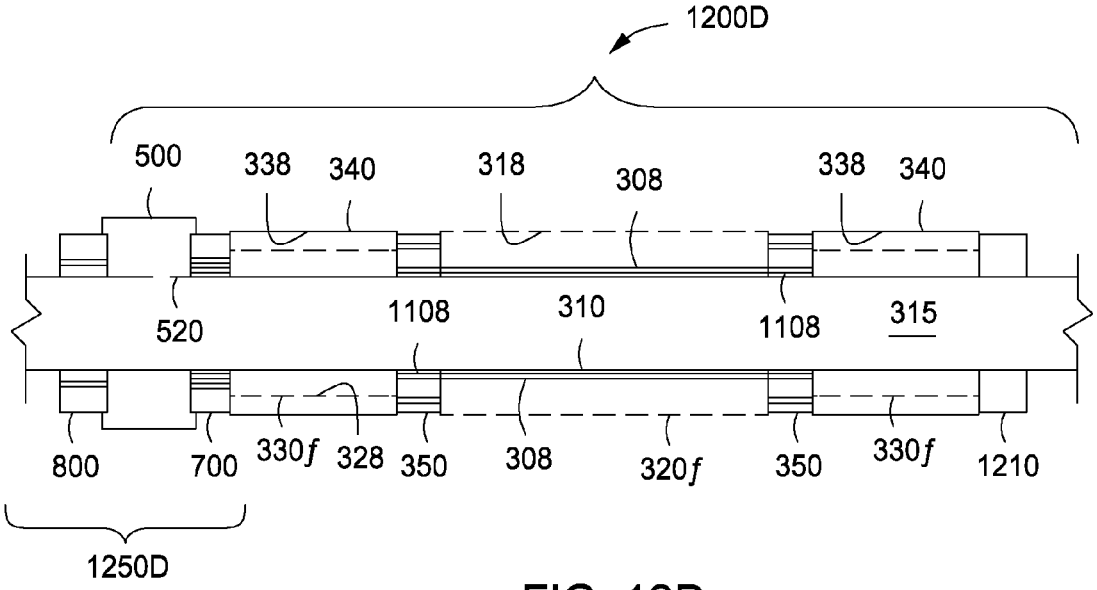

FIG. 12D presents a final sand screen joint 1200D as may be used at the end of a string of sand screen assemblies. The joint 1200D is generally in accordance with the portion of the sand screen assembly 1200B, except that a blank connector 1210 is provided at the second end. The blank connector 1210 has no transport conduits.

Figure 13:
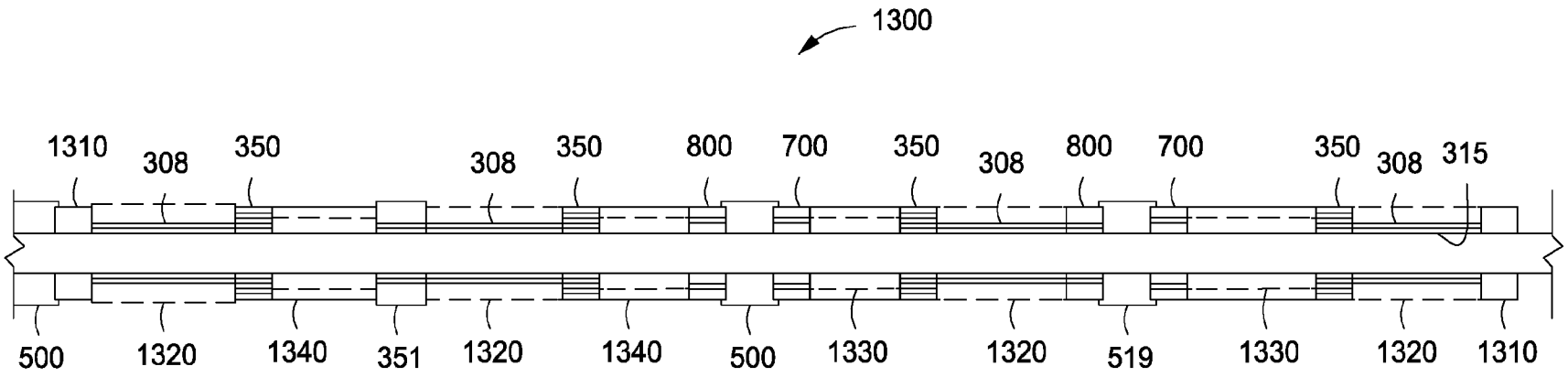
FIG. 13 shows a series of sand screens using sand screen assemblies of the present invention, in various embodiments.

FIG. 13 shows a series of sand screens 1300 using sand screen assemblies of the present invention, in certain embodiments. Sand screen joints are connected using coupling assemblies. Primary filtering conduits are shown along the series of sand screens 1300 at 1320, while secondary filtering conduits are shown along the series of sand screens 1300 at 1330. The coupling assembly 501 can be selectively replaced by in-flow ring 351 or by a coupling assembly that does not employ the flow ports 520. Blank connectors 1310 are used at opposing ends of the series 1300.

Preferably, in-flow control devices are placed along the series 1300. The in-flow control devices may reside along the flow ports 520 within one or more of the coupling joints 500. Alternatively, in-flow control devices may reside along one or more of the in-flow rings 350, such as along the primary in-flow channels 1118 or the secondary in-flow channels 1108. Alternatively still, fluid control devices may reside along the transport conduits (not shown in the FIG. 13 series of drawings). Alternatively still, in-flow control devices may reside along the flow-through channels of the load sleeves 700 and/or the torque sleeves 800.

In the series of sand screens 1300, indirect fluid flow paths (or maze compartments) are provided by the screens 1320, 1330 between coupling assemblies. Transport conduits are intended to be installed to connect the region between the secondary screens 1330 and the base pipe 310 from one maze compartment to the next maze compartment. Appropriate sealing rings (not shown) are provided as the transport conduits enter and exit the screens.

It is also observed that the sand screen assemblies 1200 and the series of sand screens 1300 beneficially protect the integrity of the filtering media and the ability of the tool to control an ingress of sand. If a primary screen 1320 is locally damaged, any ingressing solid material will be retained by the secondary filter media 1330, or screen, in that maze compartment. As the secondary screen 1330 is packed with incoming solids, the production flow is diverted to the adjacent non-damaged maze compartment, such as through the transport conduits.

After a damaged maze compartment stops taking any significant flow, the production continues through the remaining maze compartments without interruption. The local damage on the primary screen 1320 is self-mitigated without complex monitoring or control system.

The use of maze compartments was disclosed in U.S. Ser. No. 14/188,565 entitled "Sand Control Screen Having Improved Reliability," mentioned above. The screen described therein may provide in-flow control or production management over an entire completion interval using in-flow control devices installed on each screen joint. However, the present screen assemblies, when assembled in series, offer three-tiered in-flow control.

The first tier is controlled by in-flow control devices that may be placed at or near the manifold region 518 to control the flow of fluids through the flow port 520. The ICD's may be shared by multiple joints and serve for production profile management on the reservoir level, or over the entire completion interval. Such ICD-sharing feature increases design flexibility and reduces ICD plugging risk.

The second tier is controlled by the resistance in the in-flow rings 350 within each maze compartment, coupled with the resistance of the transport conduits 308 connecting two adjacent maze compartments. The second tier controls the in-flow profile among multiple maze compartments.

The third tier is controlled by the rib 316, 326 height or the radial clearance between the base pipes 310 and the primary or secondary filter media. The third tier controls the in-flow profile within each maze compartment.

An example of the secondary fluid flow path in a sand screen assembly as described above is as follows:

from the wellbore annulus 202 (or formation) and into the first annular region (the annulus 318 between the base pipe 310 and the surrounding primary filter medium 320*f*);

along the base pipe 310 and through the primary in-flow channels 1118 of the in-flow ring 350;

along the third annular region (the annulus 338 between the secondary filter medium 330*f* and the surrounding blank housing 340);

through the secondary filter medium 330*f* and into the second annular region (the annulus 328 between the base pipe 310 and the surrounding secondary filter medium 330*f*);

along the outer diameter of the base pipe 310 and through the secondary in-flow channels 1108 of an in-flow ring 350 (or, optionally, 351);

into the transport conduits 308 extending within the first annular region(s) 318 (and, optionally, through a second annular region 328);

to the manifold region 518 along the coupling assembly 1250, and through the flow ports 520 in the coupling assembly 1250, and into the primary flow path 315 formed within the base pipes 310 and the tubing 130.

Figure 14:
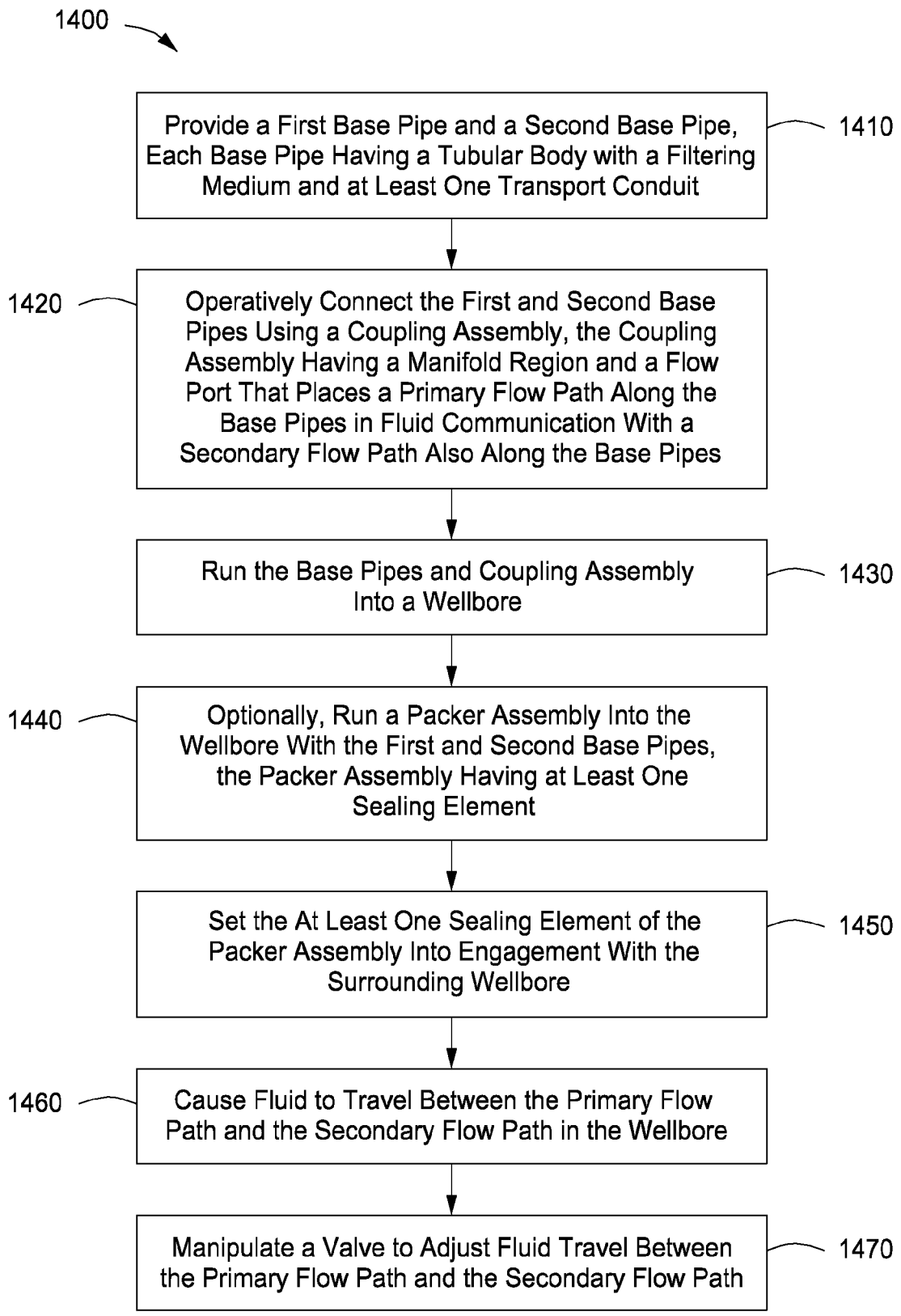
FIG. 14 is a flowchart for a method of completing a wellbore, in one embodiment. The method involves running a joint assembly into a wellbore, and causing fluids to flow between primary and secondary flow paths along the joint assembly.

Based on the above descriptions, a method for completing an open-hole wellbore is provided herein. The method is presented in FIG. 14. FIG. 14 provides a flow chart presenting steps for a method 1400 of completing a wellbore in a subsurface formation, in certain embodiments. The wellbore includes a lower portion completed as an open-hole.

The method 1400 first includes providing a first base pipe and a second base pipe. This is shown at Box 1410. The two base pipes are connected in series. Each base pipe comprises a tubular body. The tubular bodies each have a first end, a second end and a bore defined there between. The bore forms a primary flow path for fluids.

In a preferred embodiment, the tubular bodies comprise a series of blank pipes threadedly connected to form the primary flow path, with a filter medium radially disposed around the pipes and along a substantial portion of the pipes so as to form a sand screen. Preferably, an indirect flow path is provided using, for example, the sand screen portions 920, 930 of FIGS. 9A and 9B.

Each of the base pipes also has at least one transport conduit. The transport conduit resides along an outer diameter of the base pipes for transporting fluids as a secondary flow path. The transport conduits reside in a first annular region, that is, the annulus formed between the base pipes and the surrounding primary filter medium. Of interest, the transport conduits are segmented, meaning they do not extend through the second annular region, that is, the annulus formed between the base pipes and the surrounding secondary filter medium. In a less-preferred embodiment, the transport conduits also reside in selected segments along the second annular region, that is, the annulus formed between the base pipes and the surrounding secondary filter medium.

The method also includes operatively connecting the second end of the first base pipe to the first end of the second base pipe. This step is shown in Box 1420. The connecting step is done by means of a coupling assembly. In one aspect, the coupling assembly includes a load sleeve, a torque sleeve, and an intermediate coupling joint, with the load sleeve, the torque sleeve and the coupling joint being arranged and connected as described above such as in FIG. 6, and in FIGS. 12A and 12B. Other sleeve arrangements may be offered.

Of note, a flow port resides adjacent the manifold in the coupling joint. The flow port places the primary flow path in fluid communication with the secondary flow path. The manifold region also places respective transport conduits of the base pipes in fluid communication.

Various arrangements for the transport conduits may be used. Preferably, the transport conduits represent four conduits radially disposed about the base pipe. The transport conduits may have different diameters and different lengths. In one aspect, each of the transport conduits along the base pipe extends substantially along the length of the secondary filtering section.

The joint assembly further comprises an in-flow control device. The in-flow control device may reside adjacent an opening in the flow port along the coupling joint. The in-flow control device is configured to increase or decrease fluid flow through the flow port. The in-flow control device may be, for example, a sliding sleeve or a valve. The method may then further comprise adjusting the in-flow control device to increase or decrease fluid flow through the flow port. This may be done through a radio frequency signal, a mechanical shifting tool, or hydraulic pressure. The in-flow control device may be a nozzle or a tube. The inflow control device may also be an autonomous device like the Equi-Flow® ICD from Halliburton Energy Services, Inc. of Houston, Tex., the RCP valve from StatOil of Stavanger, Norway, the FloSure™ in-flow control valve from Tendeka of Aberdeen, Scotland, or InflowControl's AICV valve.

In one aspect, an in-flow control device is placed adjacent the primary in-flow channels of the in-flow control rings. In another aspect, an in-flow control device is placed adjacent the secondary in-flow channels. Adjusting these in-flow control devices adjusts the flow of hydrocarbon fluids through the in-flow control rings.

In still another aspect, the height of the ribs along the first annular region, or along the second annular region, or both is adjusted. Adjusting the height of the ribs adjusts the flow of hydrocarbon fluids along the base pipes or the in-flow profile along the primary filtering conduit.

The method 1400 also includes running the base pipes into the wellbore. This is seen at Box 1430.

Optionally, the method 1400 further includes running a packer assembly into the wellbore with the base pipes. This is shown at Box 1440. The packer assembly may include at least one, and preferably two, mechanically-set packers. These represent an upper packer and a lower packer. Each packer will have an inner mandrel, and a sealing element external to the inner mandrel. Each mechanically-set packer has a sealing element that may be, for example, from about 6 inches (15.2 cm) to 24 inches (61.0 cm) in length.

A swellable packer element may be employed intermediate a pair of mechanically-set packers or replacing the mechanically-set packers. The swellable packer element is preferably about 3 feet (0.91 meters) to 40 feet (12.2 meters) in length. In one aspect, the swellable packer element is fabricated from an elastomeric material. The swellable packer element is actuated over time in the presence of a fluid such as water, gas, oil, or a chemical. Swelling may take place, for example, should one of the mechanically-set packer elements fails. Alternatively, swelling may take place over time as fluids in the formation surrounding the swellable packer element contact the swellable packer element.

In any instance, the method 1400 will then also include setting the at least one sealing element. This is provided at Box 1450.

The method 1400 additionally includes causing fluid to travel between the primary flow path and the secondary flow path. This is indicated at Box 1460. Causing fluid to travel may mean producing hydrocarbon fluids. In this instance, fluids travel from at least one of the transport conduits in the annulus into the base pipes. Alternatively, causing fluid to travel may mean injecting an aqueous solution into the formation surrounding the base pipes. In this instance, fluids travel from the base pipes and into at least one of the transport conduits. Alternatively still, causing fluid to travel may mean injecting a treatment fluid into the formation. In this instance, fluids such as acid travel from the base pipes and into at least one of the transport conduits, and then into the formation. The treatment fluid may be, for example, a gas, an aqueous solution, steam, diluent, solvent, fluid loss control material, viscosified gel, viscoelastic fluid, chelating agent, acid, or a chemical consolidation agent. In all instances, fluids travel through the at least one flow port along at least one coupling joint.

The above method 1400 may be used to selectively produce from or inject into multiple zones. This provides enhanced subsurface production or injection control in a multi-zone completion wellbore. Further, the method 1400 may be used to inject a treating fluid along an open-hole formation in a multi-zone completion wellbore.

While it will be apparent that the inventions herein described are well calculated to achieve the benefits and advantages set forth above, it will be appreciated that the inventions are susceptible to modification, variation and change without departing from the spirit thereof. Improved methods for completing an open-hole wellbore are provided so as to seal off one or more selected subsurface intervals. An improved zonal isolation apparatus is also provided. The inventions permit an operator to produce fluids from or to inject fluids into a selected subsurface interval.

What is claimed is:

1. A sand screen assembly residing within a wellbore, comprising:

a first base pipe and a second base pipe connected in series, each base pipe comprising a blank tubular body having a first end, a second end, and a bore there between forming a primary flow path for production fluids;

filter media disposed circumferentially around and residing substantially along the tubular body of each base pipe, the filter media creating an indirect flow path for production fluids moving from a surrounding subsurface formation towards an outer diameter of the base pipes;

one or more transport conduits residing along selected portions of the outer diameter of the base pipes, the transport conduits each having a bore for providing a secondary flow path for production fluids;

a cylindrical in-flow ring disposed along the base pipes intermediate sections of the filter media, each in-flow ring having (i) a body defining an inner diameter that sealingly receives a base pipe, and (ii) one or more flow conduits in the body of the in-flow ring placing the bore of each transport conduit in fluid communication with the filter media as part of the secondary flow path;

a coupling assembly operatively connecting the second end of the first base pipe to the first end of the second base pipe, wherein the coupling assembly comprises a manifold that receives fluids from the transport conduits; and a flow port proximate the manifold that places the primary flow path in fluid communication with the secondary flow path; and one or more in-flow control devices for controlling fluid flow between the primary flow path and the secondary flow path;

wherein the filter media comprises;

at least one primary filtering conduit, the primary filtering conduit forming a first annular region between the tubular body and the surrounding primary filtering conduit, at least one secondary filtering conduit adjacent each primary filtering conduit at an end, the secondary filtering conduit forming a second annular region between the tubular body and the surrounding secondary filtering conduit; and a blank tubular housing circumscribing the second filtering conduit and forming a third annular region between the second filtering conduit and the surrounding housing; and wherein the transport conduits reside within each first annular region.

2. The sand screen assembly of claim 1, wherein each in-flow ring resides between a primary filtering conduit and a laterally adjacent secondary filtering conduit.

3. The sand screen assembly of claim 2, wherein the flow conduits of the in-flow ring comprise (i) one or more primary in-flow channels providing fluid communication between the first annular region and the third annular region, and (ii) one or more secondary in-flow channels providing fluid communication between the second annular region and the bores of the transport conduits.

4. The sand screen assembly of claim 3, wherein the in-flow ring has an outer diameter that sealingly receives the blank tubular housing at an end.

5. The sand screen assembly of claim 4, wherein:

the primary filtering conduit of each base pipe defines a pair of primary filtering conduits residing at opposing ends of the secondary filtering conduit, thereby forming a pair of opposing first annular regions along each base pipe; and in-flow rings are disposed along the base pipes at opposing ends of the second filtering conduit.

6. The sand screen assembly of claim 3, wherein each of the at least one transport conduits along the base pipes extends substantially along the length of the respective first annular region.

7. The sand screen assembly of claim 3, wherein at least one of the transport conduits along the base pipes also extends substantially along the length of the second annular region.

8. The sand screen assembly of claim 3, wherein:

the in-flow control device is placed along (i) one or more of the primary in-flow channels, (ii) one or more of the secondary in-flow channels, or (iii) one or more transport conduits; and whereby the in-flow control device is configured to control the flow of production fluids along the secondary flow path.

9. The sand screen assembly of claim 3, wherein the coupling assembly comprises:

a first sleeve mechanically connected proximate to the first end of the second base pipe;

a second sleeve mechanically connected proximate to the second end of the first base pipe; and an intermediate coupling joint comprising a main tubular body defining a bore in fluid communication with the primary flow path, the main tubular body having a first end and a second end, wherein the first end is threadedly connected to the second end of the first base pipe, and the second end is threadedly connected to the first end of the second base pipe.

10. The sand screen assembly of claim 9, wherein:

(i) the first sleeve is a load sleeve and the second sleeve is a torque sleeve; or (ii) the first sleeve is a torque sleeve and the second sleeve is a load sleeve; and each sleeve comprises a tubular body having a plurality of transport channels therein.

11. The sand screen assembly of claim 10, wherein:

the first sleeve is a load sleeve and the second sleeve is a torque sleeve;

the load sleeve and the torque sleeve each comprises:

a tubular body defining an inner bore therein in fluid communication with the primary flow path, and transport channels disposed longitudinally along main tubular body of the sleeves in fluid communication with the secondary flow path; and the coupling joint further comprises:

a coaxial sleeve positioned around the main tubular body, the sleeve forming an annual region between the main tubular body and the coaxial sleeve, with the annular region defining the manifold, and the manifold placing the transport conduits of the load sleeve and of the torque sleeve in fluid communication.

12. The sand screen assembly of claim 11, wherein a second filtering conduit along the second base pipe resides adjacent a load sleeve.

13. The sand screen assembly of claim 11, wherein a primary filtering conduit along the second base pipe resides adjacent a load sleeve.

14. The sand screen assembly of claim 10, wherein:

the in-flow control device is placed along (i) the transport channels of the load sleeve, or (ii) the transport channels of the torque sleeve;

whereby the in-flow control device is configured to increase or decrease fluid flow through the corresponding sleeve.

15. The sand screen assembly of claim 14, wherein the flow port comprises (i) a through opening in the main tubular body of the coupling joint, (ii) a through-opening in the second end of the first base pipe, or (iii) a through-opening in the first end of the second base pipe.

16. The sand screen assembly of claim 15, wherein:

the in-flow control device is placed along the coupling joint adjacent an opening in the flow port;

whereby the in-flow control device is configured to increase or decrease fluid flow through the flow port.

17. The sand screen assembly of claim 1, wherein the filter media of each filtering conduit comprises a wire-wrapped screen, a slotted liner, a ceramic screen, a membrane screen, a sintered metal screen, a wire-mesh screen, a shaped memory polymer, or a pre-packed solid particle bed.

18. The sand screen assembly of claim 1, further comprising:

a packer assembly residing at the second end of the second base pipe, the packer assembly comprising an inner mandrel and at least one sealing element.

19. The sand screen assembly of claim 1, further comprising:

two or more longitudinal ribs placed within the second annular region, the ribs supporting the second filtering conduit and being sized to provide a selected flow rate within the second annular region.

20. A method for completing a wellbore in a subsurface formation, the method comprising:

providing a first base pipe and a second base pipe, with each base pipe comprising:

a blank tubular body having (i) a first end, a second end and a bore there between forming a primary flow path for fluids, and (ii) filtering media disposed circumferentially around and residing substantially along the tubular bodies, with the filtering media being configured to create an indirect flow path to an outer diameter of the base pipes;

one or more transport conduits along the outer diameter of the base pipes for transporting fluids as a secondary flow path;

a cylindrical in-flow ring disposed along the base pipes intermediate sections of the filter media, each in-flow ring having (i) a body defining an inner diameter that sealingly receives a base pipe, and (ii) one or more flow conduits in the body of the in-flow ring placing the bore of each transport, conduit in fluid communication with the filter media as part of the secondary flow path;

an in-flow control device is placed along at least one of (i) one or more the primary in-flow channels, (ii) one or more of the secondary in-flow channels, and (iii) one or more transport conduits;

wherein each of the first and second base pipes further comprises:

at least one first filtering conduit circumscribing a base pipe and forming a first annular region between the tubular body of the base pipe and the surrounding first filtering conduit;

a second filtering conduit also circumscribing a base pipe and forming a second annular region between the tubular body of the base pipe and the surrounding second filtering conduit, at least one end of the second filtering conduit being adjacent to a first filtering conduit; and a blank tubular housing circumscribing the second filtering conduit and forming a third annular region between the second filtering conduit and the surrounding housing;

and wherein the in-flow ring resides intermediate a first filtering conduit and an end of the second filtering conduit, and the transport conduits extend along the first annular region;

operatively connecting the second end of the first base pipe to the first end of the second base pipe by means of a coupling assembly, the coupling assembly comprising a manifold that receives fluids from the transport conduits, and a flow port proximate the manifold that places the primary flow path in fluid communication with the secondary flow path;

running the base pipes into the wellbore;

causing fluid to travel from the subsurface formation, through the filtering media, and into the secondary flow path;

adjusting the in-flow control device in order to control the flow of production fluids through the secondary flow path; and causing fluid to travel between the primary and secondary flow paths.

21. The method of claim 20, further comprising:

adjusting the in-flow control device to increase or decrease a flow of fluid along the secondary flow path.

22. The method of claim 20, wherein the in-flow ring has an outer diameter that sealingly receives the blank tubular housing at an end.

23. The method of claim 20, wherein each of the at least one transport conduits along the base pipes extends substantially along the length of the respective first annular region.

24. The method of claim 20, wherein at least one of the transport conduits along the base pipes also extends substantially along the length of the second annular region.

25. The method of claim 20, wherein the in-flow control device is controlled by a radio frequency signal, a mechanical shifting tool, or hydraulic pressure.

26. The method of claim 20, wherein:

the first filtering conduit of each base pipe defines a pair of first filtering conduits residing at opposing ends of the second filtering conduit, thereby forming a pair of opposing first annular regions along each base pipe; and in-flow rings are disposed along the base pipes at opposing ends of the second filtering conduit adjacent the first filtering conduits.

27. The method of claim 20, wherein:

the second filtering conduit defines a pair of second filtering conduits residing at opposing ends of the first filtering conduit, thereby forming a pair of second annular regions; and each of the first and second base pipes further comprises a pair of in-flow rings disposed along the base pipe at opposing ends of the first filtering conduit, the in-flow rings placing the first annular region in fluid communication with the third annular region as part of the indirect flow path.

28. The method of claim 20, wherein:

the second filtering conduit of each base pipe comprises ribs radially disposed around the base pipe to support the second filtering medium, and the method further comprises adjusting a height of the ribs to adjust the flow of production fluids through the second annular region.

29. The method of claim 20, wherein the coupling assembly comprises:

a first sleeve mechanically connected proximate to the first end of the second base pipe;

a second sleeve mechanically connected proximate to the second end of the first base pipe; and an intermediate coupling joint comprising a main tubular body defining a bore in fluid communication with the primary flow path, the main tubular body having a first end and a second end, wherein the first end is threadedly connected to the second end of the first base pipe, and the second end is threadedly connected to the first end of the second base pipe.

30. The method of claim 29, wherein:

each sleeve comprises a tubular body having a plurality of transport channels disposed longitudinally along the tubular body in fluid communication with the secondary flow path; and the coupling joint further comprises a coaxial sleeve positioned around the main tubular body, the sleeve forming an annual region between the main tubular body and the coaxial sleeve, with the annular region defining the manifold, and the manifold placing the transport conduits of the load sleeve and of the torque sleeve in fluid communication.

31. The method of claim 30, further comprising:

adjusting an in-flow control device placed along the transport channels of a sleeve.

32. The method of claim 30, wherein the flow port comprises (i) a through opening in the main tubular body of the coupling joint, (ii) a through-opening in the second end of the first base pipe, or (iii) a through-opening in the first end of the second base pipe.

33. The method of claim 32, wherein:

the coupling joint further comprises an in-flow control device adjacent an opening in the flow ports; and the method further comprises adjusting the in-flow control device to increase or decrease fluid flow through the flow ports.

34. The method of claim 20, further comprising:

adjusting an in-flow control device residing within the coupling assembly in order to adjust the flow of production fluids from the secondary flow path to the primary flow path.

35. The method of claim 20, further comprising:

producing hydrocarbon fluids through the base pipes of the first and second base pipes from at least one interval along the wellbore, wherein producing hydrocarbon fluids causes hydrocarbon fluids to travel from the secondary flow path to the primary flow path.

36. The method of claim 20, further comprising:

injecting a fluid through the base pipes and into the wellbore along at least one interval, wherein injecting the fluid causes fluids to travel from the primary flow path to the secondary flow path.

37. The method of claim 20, further comprising:

providing a third base pipe, the third base pipe also comprising:

a blank tubular body having (i) a first end, a second end and a bore there between forming a primary flow path for fluids, and (ii) filtering media disposed circumferentially around and residing substantially along the tubular body of the third base pipe, with the filtering media being configured to create an indirect flow path to an outer diameter of the tubular body of the third base pipe;

one or more transport conduits along an outer diameter of the third base pipe for transporting fluids as a secondary flow path;

a cylindrical in-flow ring disposed along the third base pipe intermediate sections of the filter media, the in-flow ring having (i) a body defining an inner diameter that sealingly receives the tubular body of the third base pipe, and (ii) flow conduits placing the bore of each transport conduit in fluid communication with the filter media as part of the secondary flow path.

38. The method of claim 37, further comprising:

operatively connecting the first end of the third base pipe to the second end of the second base pipe by means of a coupling assembly prior to running the base pipes into the wellbore; or operatively connecting the second end of the third base pipe to the first end of the first base pipe by means of a coupling assembly prior to running the base pipes into the wellbore, the coupling assembly comprising a blank manifold that receives fluids from the transport conduits.

39. The method of claim 38, wherein the third base pipe further comprises:

at least one first filtering conduit circumscribing the tubular body of the third base pipe and forming a first annular region between the tubular body and the surrounding first filtering conduit;

a second filtering conduit also circumscribing the tubular body of the third base pipe and forming a second annular region between the tubular body of the third base pipe and the surrounding second filtering conduit, at least one end of the second filtering conduit being adjacent to a first filtering conduit; and a blank tubular housing circumscribing the second filtering conduit and forming a third annular region between the second filtering conduit and the surrounding housing;

and wherein the in-flow ring resides intermediate a first filtering conduit and an end of the second filtering conduit.

40. The method of claim 38, wherein the transport conduits in the third base pipe extend along a first annular region of the third base pipe.

41. The method of claim 40, wherein the transport conduits in the third base pipe also extend along a second annular region of the third base pipe.

* * * * *